US006175349B1

(12) United States Patent
Kokuhata et al.

(10) Patent No.: US 6,175,349 B1
(45) Date of Patent: Jan. 16, 2001

(54) CIRCUIT FOR GENERATING A CONSTANT VOLTAGE FROM A PLURALITY OF PREDETERMINED VOLTAGES USING A CAPACITIVE ELEMENT AND SWITCH, AND A LIQUID CRYSTAL DISPLAY APPARATUS EMPLOYING SUCH A CIRCUIT

(75) Inventors: Yoshiyuki Kokuhata, Nara; Masahiro Takahashi, Tenri, both of (JP)

(73) Assignee: Sharp Kabushiki Kaisha, Osaka (JP)

( * ) Notice: Under 35 U.S.C. 154(b), the term of this patent shall be extended for 0 days.

(21) Appl. No.: 09/012,299

(22) Filed: Jan. 23, 1998

(30) Foreign Application Priority Data

Jan. 27, 1997 (JP) ..... 9-012687

(51) Int. Cl.[7] ..... G09G 3/36
(52) U.S. Cl. ..... 345/95; 345/87
(58) Field of Search ..... 345/87, 92, 95, 345/210, 211, 212, 213, 214

(56) References Cited

U.S. PATENT DOCUMENTS 5,510,814 * 4/1996 Ise ..... 345/211
5,663,744 * 9/1997 Seike et al. ..... 345/95
5,760,759 * 6/1998 Tanaka et al. ..... 345/210
5,859,632 * 1/1999 Ito ..... 345/211
5,986,669 * 11/1999 Yamazaki ..... 345/95

FOREIGN PATENT DOCUMENTS 7-120718 5/1995 (JP) .

* cited by examiner

*Primary Examiner*—Vijay Shankar
(74) *Attorney, Agent, or Firm*—Dike, Bronstein, Roberts & Cushman, LLP; David G. Conlin

(57) ABSTRACT

A voltage generation circuit includes a potential line for a voltage value VA, a group of potential lines constituted by potential lines for voltage values V1, VM and VS, respectively, a potential line for a voltage value VB, a first capacitor, a second capacitor having a capacitance equal to the capacitance of the first capacitor, a first switch for selectively connecting the first terminal of the first capacitor to the potential line and one potential line out of the group of potential lines, and a second switch for selectively connecting a second terminal of the first capacitor to the potential line that applies a potential symmetric to the potential of one predetermined potential line out of the group of potential lines and to the first terminal of the second capacitor. The second capacitor includes first and second terminals connected to the potential line for VB and the one potential line out of the group of the potential lines, respectively. Connection switching of the first and second switches is controlled so that the first and second capacitors are charged and discharged in a complementary manner.

11 Claims, 16 Drawing Sheets

CIRCUIT FOR GENERATING A CONSTANT VOLTAGE FROM A PLURALITY OF PREDETERMINED VOLTAGES USING A CAPACITIVE ELEMENT AND SWITCH, AND A LIQUID CRYSTAL DISPLAY APPARATUS EMPLOYING SUCH A CIRCUIT

BACKGROUND OF THE INVENTION

1. Field of the Invention

The present invention relates to a liquid crystal display apparatus and a voltage generation circuit for a liquid crystal display apparatus. More particularly, the present invention relates to a liquid crystal display apparatus for driving a pixel by applying a predetermined modulation voltage corresponding to an illuminated display/unilluminated display to a data electrode, and applying a predetermined programming voltage to a scanning electrode in line sequence, and a voltage generation circuit therefor.

2. Description of the Background Art

In these few years, a liquid crystal display is adapted in the products of various fields such as in the application of AV (Audio and Visual) and OA (Office Automation) owing to the advantages of lightweight, thin and small size, and low power consumption features.

Particularly for those driven by a battery such as a portable equipment, the requirement of reducing power consumption as much as possible is great. Development of a reflective liquid crystal display that does not use a back light of relatively great power consumption and research for reducing the power consumption of the liquid crystal display per se are in progress.

Referring to FIG. 1, a conventional liquid crystal display includes a display panel 1701, a scanning electrode signal driver 1702 for applying a predetermined voltage to a scanning electrode line of display panel 1701 in line sequence, a data electrode signal driver 1703 for applying a predetermined voltage to a data electrode line according to the display information, a voltage generation unit 1706 for generating a voltage to be applied to the Ad liquid crystal display, and a control unit 1705 for providing a control signal to scanning electrode signal driver 1702, data electrode signal driver 1703 and voltage generation unit 1706 for displaying the input information from an input signal line 1704. Voltage generation unit 1706 includes a DC/DC converter 2101 that will be described afterwards.

Referring to FIG. 2, a display panel 1701 includes a plurality of pixels arranged in a matrix. Each pixel includes a liquid crystal display element 1801 connected between a corresponding scanning electrode line (Y1–Ym) and data electrode line (X1–Xn).

Referring to FIG. 1 again, scanning electrode signal driver 1702 includes a shift transistor not shown, and an analog switch. Data electrode signal driver 1703 includes a shift register not shown, a latch circuit, and an analog switch. Scanning electrode signal driver 1702 applies a predetermined voltage to respective scanning electrode lines (Y1–Ym) according to a latch pulse LP and an alternating signal M.

Referring to FIG. 3, scanning electrode signal driver 1702 operates as set forth in the following. In response to latch pulse LP and alternating signal M from control unit 1705, a voltage 1907*a* of a voltage value VH or a voltage 1907*d* of a voltage value VL from voltage generation unit 1706 is applied during selected periods 1903 and 1904, and a voltage 1907*b* of a voltage value VM is applied during a nonselected period for a selected line.

As to an applied waveform 1908 of line $Y_i$. a voltage 1907*a* of a voltage value VH is applied to line $Y_i$ during a selected period 1903 in an A frame 1901 in response to latch pulse LP and alternating signal M. In the next B frame 1902, a voltage 1907*d* of a voltage value VL is applied during selected period 1904 in response to latch pulse LP and alternating signal M. In a nonselected state a voltage 1907*b* of a voltage value VM is applied to line $Y_i$.

Application of a direct current component will cause degradation in the characteristics of the liquid crystal material in a liquid crystal display. It is therefore necessary to apply a symmetrical waveform with respect to voltage 1907*b* of voltage value VM. Therefore, voltage value VL must satisfy VH−VM=VM−VL.

As to an applied waveform 1909 of line $Y_{i+1}$, voltage 1907*d* of voltage value VL is applied to line $Y_{i+1}$ during a selected period 1905 of A frame 1901, and voltage 1907*a* of a voltage value VH is applied to line $Y_{i+1}$ at a selected period 1909 in B frame 1902.

Referring to FIG. 4, data electrode signal driver 1703 operates as set forth in the following. In response to latch pulse LP and alternating signal M from control unit 1705 and a data signal D, a voltage 2008*a* of a voltage value V1 sent from voltage generation unit 1706, and a voltage 2008*b* of a voltage value VS are applied to the selected line. Here, voltage value V1=2×VM.

An applied waveform 2009 to the $X_j$th data electrode line and an applied waveform 2001 to a position ($X_j$, $Y_i$) will be described. A waveform indicated by solid line 2009*a* is applied to the $X_j$th data electrode line when the data corresponds to an illuminated display according to latch pulse LP, alternating signal M and data signal D. In the case of a nonilluminated display, a waveform indicated by broken line 2009*b* is applied to the $X_j$th data electrode line.

For example, if the liquid crystal display element of position ($X_j$, $Y_i$) corresponds to an illuminated display, a voltage of voltage value VS is applied to the $X_j$th data electrode line during a $Y_i$ line selected period 2003 in A frame 2001, and a voltage of voltage value V1 is applied to the $X_j$th data electrode line in a $Y_i$ line selected period 2004 in B frame 2002.

The applied waveform to line $Y_i$ is indicated by waveform 2010. The applied waveform to a liquid crystal display element of ($X_j$, $Y_i$) is indicated by waveform 2011. Solid line 2011*a* corresponds to a waveform of an illuminated display, and broken line 2011*b* corresponds to a waveform of an unilluminated display.

The value of the applied voltage to a liquid crystal display element of ($X_j$, $Y_i$) is |VH| and |V1−VL| in A frame and B frame, respectively, for an illuminated display. For an unilluminatd display, the applied voltage is |VH−V1| and |VL| in A frame and B frame, respectively. The applied voltage to a liquid crystal display element must be equal in A frame 2001 and B frame 2002. Therefore, $$|VL|=|VH-V1|$$

This gives us −VL=VH−V1. Considering the voltage of voltage value VM, $$VH-VM=VM-VL \tag{1}$$

is achieved by V1=2×VM.

Conventionally, a DC/DC converter is used in a voltage generation unit 1706 to generate a plurality of voltages having the above relationship as described in FIG. 1.

When a DC/DC converter 2101 is used as shown in FIG. 5, the input of a voltage of voltage value VD results in the output of a plurality of voltage values VH, V1, VM, VS and VL having the above-described relationship.

The above-described DC/DC converter has a disadvantage that the voltage conversion efficiency at the low current area is extremely low as shown in FIG. 6. This means that only a conversion efficiency of 15–25% can be achieved when the output current is 1–2 mA. Furthermore, a DC/DC converter occupies a definite size since it is a hybrid IC. There was a disadvantage that the size of the mounting substrate must be greater than the size of the DC/DC converter.

The present information society has seen significant development in portable information equipments. The demand for a lighter, thinner, and smaller display with lower power consumption seems insatiable in the field of portable information equipment. However, the usage of a DC/DC converter results in a great loss of power with constraints in the physical dimension, so that these requirements cannot be met. There is also a problem that the cost of the product cannot be reduced since a DC/DC converter is expensive.

SUMMARY OF THE INVENTION

In view of the foregoing, an object of the present invention is to provide a voltage generation circuit particularly suitable for usage in a liquid crystal display and a liquid crystal display using such a voltage generation circuit, reduced in power consumption, space, and cost.

Another object of the present invention is to provide a voltage generation circuit for a liquid crystal display that can generate a voltage having a predetermined potential difference from a predetermined plurality of voltages at a high conversion efficiency with circuitry of a simple structure with inexpensive components, and a liquid crystal display using such a voltage generation circuit.

A further object of the present invention is to provide a liquid crystal display that can further reduce power consumption while maintaining the voltage applied to a liquid crystal display element.

A voltage generation circuit according to an aspect of the present invention includes a first potential line for a voltage value VA, a second potential line for a voltage value V1, a potential line group of a potential line for a voltage value VM and a potential line for a reference voltage value VS, a third potential line for a voltage value VB, and first and second capacitive elements of equal capacitance having first and second terminals, respectively. The second capacitive element has its first terminal connected to the third potential line and the second terminal connected to a predetermined one potential line out of the potential line group. The voltage generation circuit further includes a first switching element for selectively connecting the first terminal of the first capacitive element to the first potential line and a predetermined one out of the potential line group, and a second switching element for selectively connecting the second terminal of the first capacitive element to a potential line that applies a potential symmetric to the predetermined one potential line out of the potential line group about a voltage value VM, and the first terminal of the second capacitive element. The connection switching of the first and second switching elements is controlled so that the charge and discharge of the first and second capacitive elements are carried out in a complementary manner.

According to the present invention, a control circuit alternately carries out a first operation and a second operation. In the first operation, the first and second switching elements are controlled such that the first terminal of the first capacitive element is connected to the first potential line by the first switching element, and the second terminal of the first capacitive element is connected to a potential line symmetric to the predetermined one potential line out of the potential line group about voltage value VM to charge the first capacitive element. In the second operation, the first and second switching elements are controlled such that the first terminal of the first capacitive element is connected to a predetermined one potential line out of the potential line group by the first switching element, and the second terminal of the first capacitive element is connected to the first terminal of the second capacitive element by the second switching element to discharge the first capacitive element and charge the second capacitive element with the charge of the discharged first capacitive element.

The charging and discharging operation of the first and second capacitive elements in which the charge supplied from the first potential line to charge the first capacitive element is discharged and the second capacitive element having a capacitance equal to the capacitance of the first capacitive element is charged are carried out in a complementary manner. Therefore, the potential difference between the voltage value VB of the third potential line connected to the first terminal of the second capacitive element and the voltage value of the predetermined one potential line out of the potential line group connected to the second terminal of the second capacitive element is equal to the potential difference between the voltage value VA of the first potential line connected to the first terminal of the first capacitive element and the voltage value of a potential line that provides a potential symmetric to the potential of the predetermined one potential line out of the potential line group connected to the second terminal of the first capacitive element with respect to voltage value VM. More specifically, let (VM+h) be the voltage value of the predetermined one potential line out of the potential line group and (VM−h) be the voltage value of the potential line that provides a potential symmetric to the potential of the predetermined one potential line out of the potential line group with respect to voltage value VM, then $$(VM+h)-VB=VA-(VM-h)$$

Therefore, $$(VA-VM)=(VM-VB)$$

Let VA=VH and VB=VL, then $$(VH-VM)=(VM-VL)$$

so that voltage value VB(=VL) satisfies equation (1). As a result, a voltage value VB satisfying the predetermined condition is generated at the third potential line connected to the first terminal of the second capacitive element.

Therefore, a predetermined voltage can be obtained with high conversion efficiency from a predetermined number of voltages with circuitry of a simple structure formed of inexpensive components of a switching element and a capacitive element. As a result, a voltage generation circuit for a liquid crystal display that can have power consumption, space, and cost reduced can be obtained.

The above-mentioned predetermined one potential line can be a potential line supplying a voltage value VM, a second potential line supplying voltage value V1 or a potential line supplying voltage value VS.

In a certain preferable embodiment, voltage value VA is voltage value VH that has a positive polarity with respect to reference voltage value VS, and voltage VB is voltage value VL having a negative polarity with respect to reference voltage VS. In another preferable embodiment, voltage value VA is a voltage value VL having a negative polarity with respect to reference voltage VS, and voltage VB is a voltage value VH having a positive polarity with respect to reference voltage value VS.

Further preferably, at least one of the first and second switching elements is an MOSFET.

According to another aspect of the present invention, a liquid crystal display includes a plurality of scanning electrodes arranged parallel to each other, a plurality of data electrodes arranged parallel to each other in a direction crossing the scanning electrodes, a plurality of display pixels provided at respective crossings of a scan-side electrode and a data-side electrode, a scanning electrode driver connected to a scanning electrode, a data electrode driver connected to a data electrode, and a voltage generation circuit for supplying a predetermined plural types of voltages to the scanning electrode driver and the data electrode driver. Each display pixel includes a liquid crystal display element connected in series between a corresponding scanning electrode and a data electrode, and a two-terminal type nonlinear element. The predetermined plural of types of voltages include a reference voltage value VS, predetermined voltage values VA and V1, a voltage value VM defined by VM=(V1+VS)/2, and a voltage value VB defined by the equation of (VA−VM)=(VM−VB). The voltage generation circuit generates voltage value VB from voltage values VS, VA, V1 and VM. The voltage generation circuit includes a first potential line for voltage value VA, a second potential line for voltage value V1, a potential line group of a potential line for voltage value VM and a potential line for reference voltage value VS, a third potential line for voltage value VB, a first capacitive element having first and second terminals, a second capacitive element having a first terminal connected to the third potential line and a second terminal connected to a predetermined one potential line out of the potential line group, and having a capacitance equal to the capacitance of the first capacitive element, a first switching element for selectively connecting the first terminal of the first capacitive element to the first potential line and the predetermined one potential line out of the potential line group, a second switching element for selectively connecting the second terminal of the first capacitive element to the potential line that supplies a potential symmetric to the potential of the predetermined one potential line out of the potential line group with respect to voltage value VM and the first terminal of the second capacitive element, and a control circuit for controlling the connection switching of the first and second switching elements so that the first and second capacitive elements are charged and discharged in a complementary manner.

The voltage generation circuit supplies the generated predetermined plural types of voltages to the scanning electrode signal driver and the data electrode signal driver. The 2-terminal nonlinear element conducts a current when the voltage supplied by the scanning electrode signal driver and the data electrode signal driver exceeds a predetermined voltage to apply a voltage to a liquid crystal display element. Charge is accumulated in the liquid crystal display element to which the voltage is applied. The accumulated charge is held in the liquid crystal display element by the 2-terminal nonlinear element. Therefore, the charge accumulated in the liquid crystal display element will not be discharged as long as the voltage applied to the 2-terminal nonlinear element does not exceed the predetermined voltage.

In addition to the advantage that a predetermined voltage can be obtained at high conversion efficiency from a predetermined number of voltages with circuitry of a simple structure formed of an inexpensive component of a switching element and a capacitive element, the current to be applied to the liquid crystal display element can be reduced. A liquid crystal display that can have power consumption further reduced together with reduction in space and cost can be obtained.

According to a further aspect of the present invention, a voltage generation circuit includes a first potential line for a voltage value VA, a second potential line for a voltage value VM, a third potential line for a voltage value VB, a first capacitive element including first and second terminals, a second capacitive element having a first terminal connected to the third potential line and a second terminal connected to the second potential line, and having a capacitance equal to the capacitance of the first capacitive element, a first switching element for selectively connecting the first terminal of the first capacitive element to the first potential line and the second potential line, and a second switching element for selectively connecting the second terminal of the first capacitive element to the second potential line and the first terminal of the second capacitive element. Control of the connection switching of the first and second switching elements is provided so that the first and second capacitive elements are charged and discharged in a complementary manner.

According to still another aspect of the present invention, a voltage generation circuit includes a first potential line for a voltage value VA, a second potential line for a voltage value V1, a third potential line for a voltage value VB, a fourth potential line for a reference voltage value VS, a first capacitive element having first and second terminals, a second capacitive element having a first terminal connected to the third potential line and a second terminal connected to the second potential line, and having a capacitance equal to the capacitance of the first capacitive element, a first switching element for selectively connecting the first terminal of the first capacitive element to the first potential line and the second potential line, and a second switching element for selectively connecting the second terminal of the first capacitive element to the fourth potential line and the first terminal of the second capacitive element. Control of the connection switching of the first and second switching elements is provided so that the first and second capacitive elements are charged and discharged in a complementary manner.

According to a still further aspect of the present invention, a voltage generation circuit includes a first potential line for a voltage value VA, a second potential line for a voltage value V1, a third potential line for a voltage value VB, a fourth potential line for a reference voltage value VS, a first capacitive element having first and second terminals, a second capacitive element having a first terminal connected to the third potential line and a second terminal connected to the second potential line, and having a capacitance equal to the capacitance of the first capacitive element, a first switching element for selectively connecting the first terminal of the first capacitive element to the first potential line and the fourth potential line, and a second switching element for selectively connecting the second terminal of the first capacitive element to the second potential line and the first terminal of the second capacitive element. Switching of the connection of the first and second switching elements is controlled so that the first and second capacitive elements can be charged and discharged in a complementary manner.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
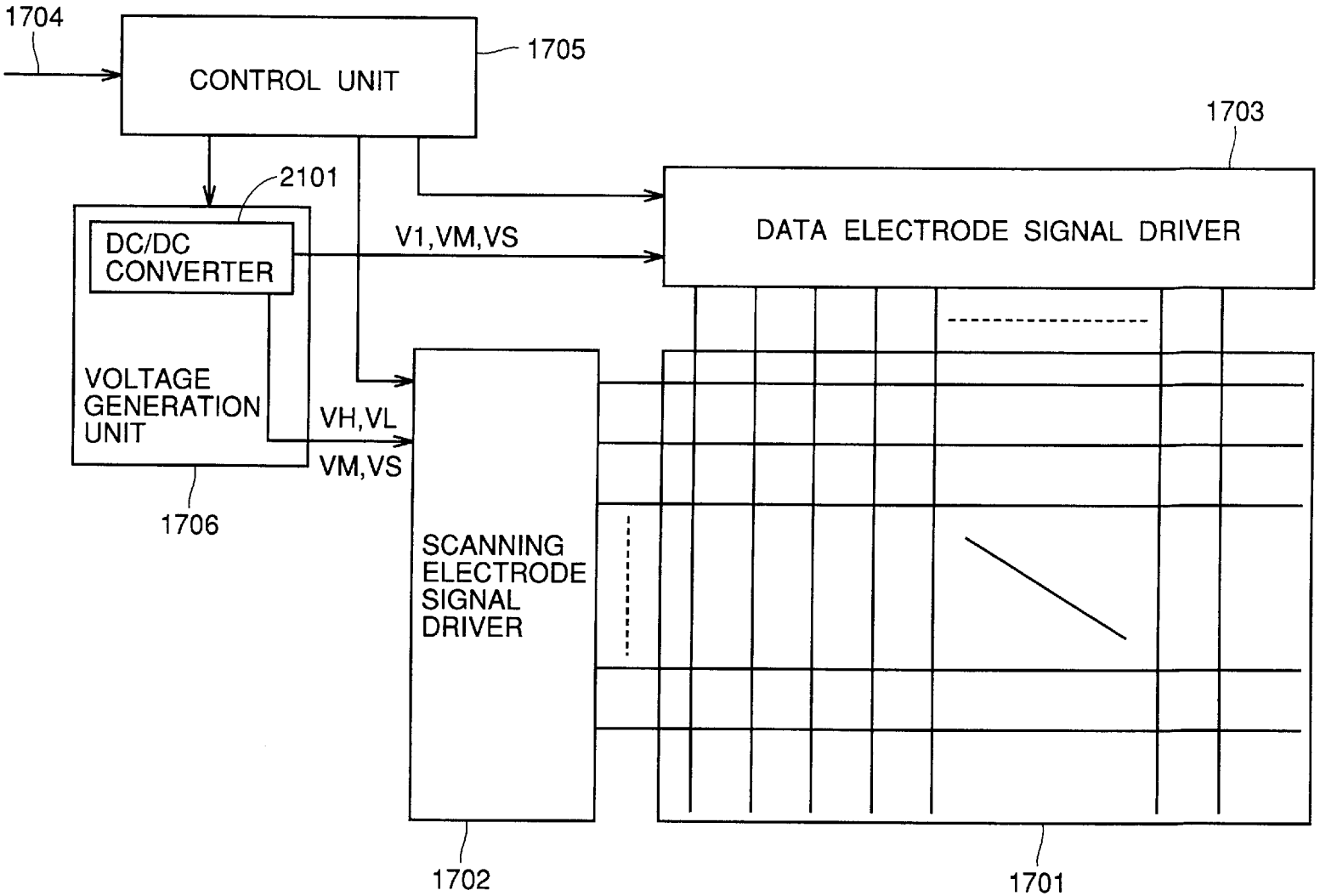
FIG. 1 PRIOR ART
FIG. 1 is a block diagram showing an entire structure of a conventional liquid crystal display.
Figure 7:
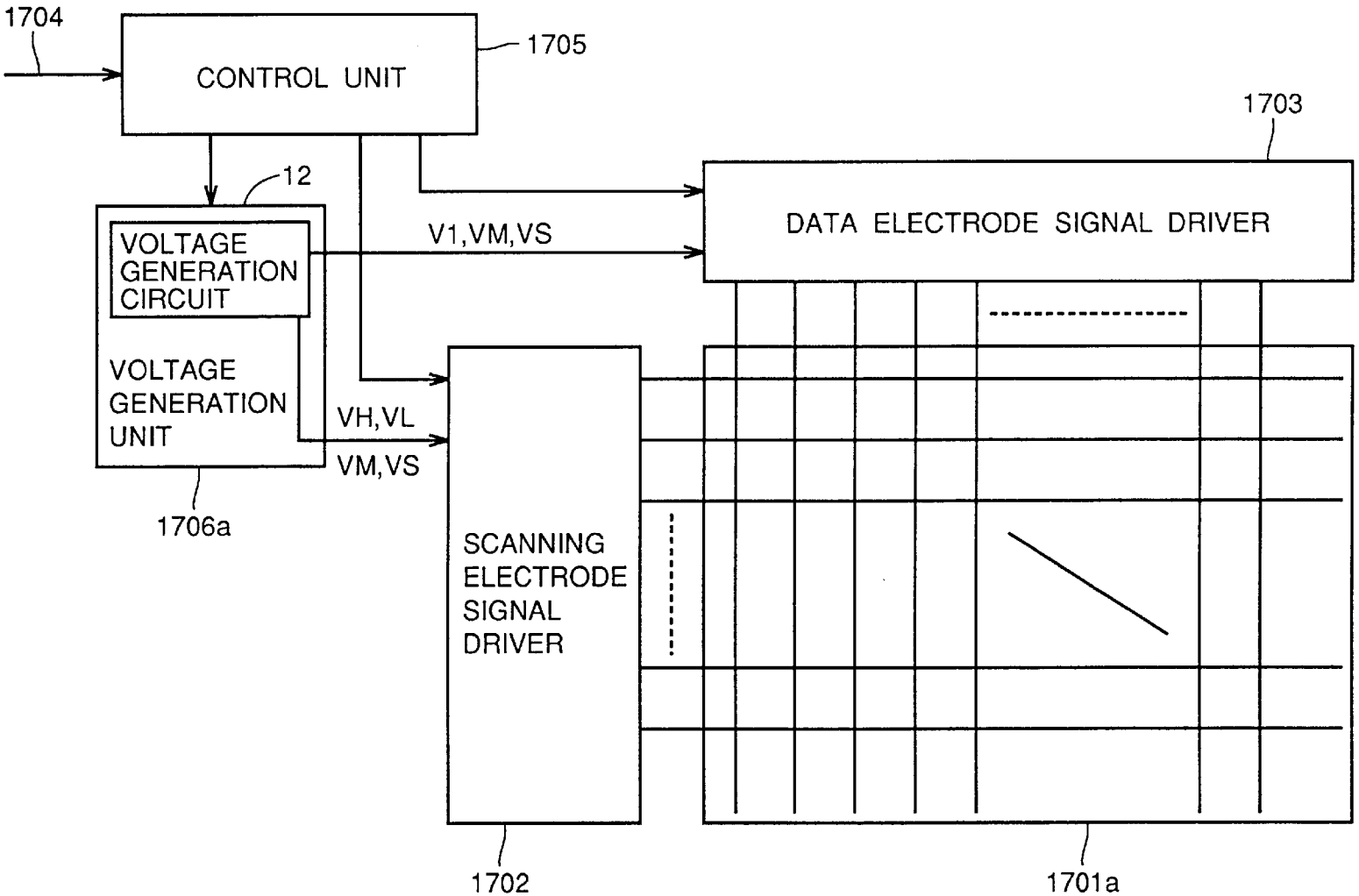
FIG. 7 is a block diagram showing an entire structure of a liquid crystal display according to a first embodiment.

The entire structure of a liquid crystal display according to a first embodiment of the present invention will be described hereinafter with reference to FIG. 7. Components corresponding to those of the conventional liquid crystal display described already with reference to FIG. 1 have the same reference characters allotted. Detailed description thereof will not be repeated here.

The liquid crystal display of the first embodiment of the present invention differs from the conventional liquid crystal display in that a voltage generation unit 1706*a* including a voltage generation circuit 12 is substituted for voltage generation unit 1706 including DC/DC converter 2101, and that a display panel 1701*a* including a 2-terminal nonlinear element that will be described afterwards is substituted for display panel 1701 including liquid crystal display element 1801.

Figure 8:
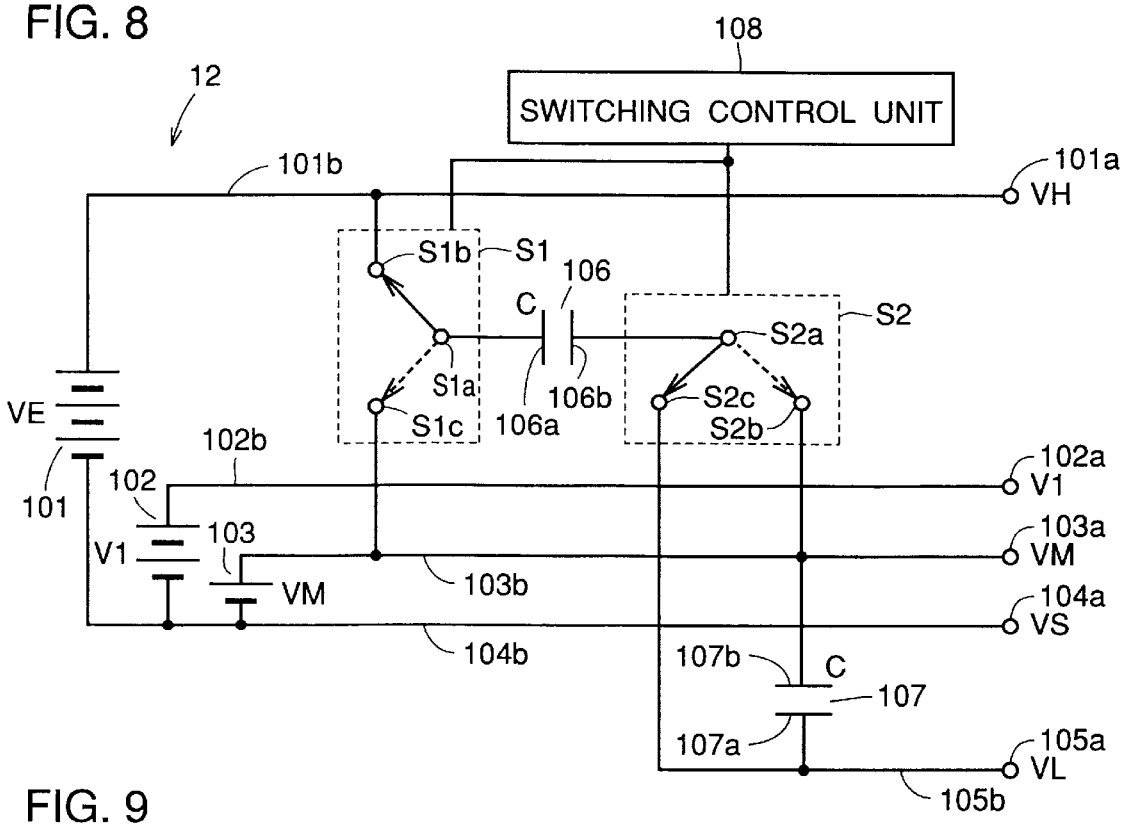
FIG. 8 is a diagram for describing a structure of a voltage generation circuit according to the first embodiment.

Referring to FIG. 8, a voltage generation circuit 12 according to the first embodiment of the present invention includes a reference potential line 104*b* supplying a reference voltage value VS, a power supply 101 having one end connected to reference potential line 104*b* for supplying a voltage of a voltage value VE that has a positive polarity with respect to reference voltage value VS, a power supply 102 having one end connected to reference potential line 104*b* for supplying a voltage of voltage value V1, a power source 103 having one end connected to reference potential line 104*b* for supplying a voltage of a voltage value VM defined by VM=(VS+VS)/2, a first potential line 101*b* connected to the other end of power supply 101 for supplying a voltage value VE, a second potential line 102*b* connected to the other end of power supply 102 for supplying a voltage value V1 symmetric to reference voltage value VS with respect to voltage value VM, a potential line 103*b* connected to power supply 103 for supplying a voltage of voltage value VM, and a third potential line 105*b* from which a voltage of voltage value VL is provided.

Voltage generation circuit 12 further includes a capacitor 106 with terminals 106*a* and 106*b*, a capacitor 107 with a terminal 107*a* and a terminal 107*b* connected to potential line 103*b*, and having a capacitance C equal to the capacitance value C of capacitor 106, a switching element S1 for selectively connecting terminal 106*a* of capacitor 106 to potential line 101*b* and potential line 103*b*, a switching element S2 for selectively connecting terminal 106*b* of capacitor 106 to potential line 103*b* and terminal 107*a* of capacitor 107, a switching control unit 108 connected to switching elements S1 and S2 for controlling the connection switching of switching elements S1 and S2 so that capacitors 106 and 107 are charged and discharged in a complementary manner, and output terminals 101*a*, 102*a*, 103*a*, 104*a* and 105*a* connected to potential lines 101*b*, 102*b*, 103*b*, 104*b* and 105*b*, respectively.

Switching element S1 includes a terminal S1*a* connected to terminal 106*a* of capacitor 106, a terminal S1*b* connected to potential line 101*b*, and a terminal S1*c* connected to potential line 103*b*. Switching element S2 includes a terminal S2*a* connected to terminal 106*b* of capacitor 106, a terminal S2*b* connected to potential line 103*b*, and a terminal S2*c* connected to terminal 107*a* of capacitor 107.

The flow of the current in voltage generation circuit 12 is set forth in the following.

Figure 9:
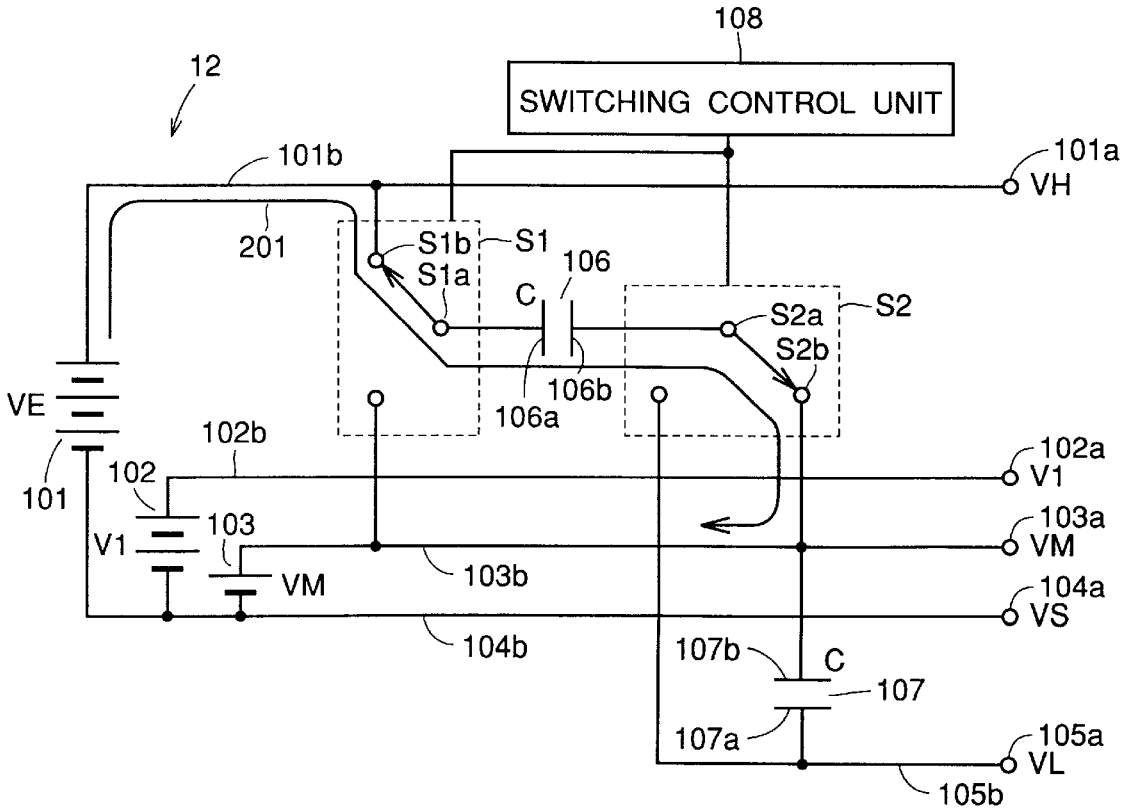
FIGS. 9 and 10 are diagrams for describing an operation of the voltage generation circuit of the first embodiment.
Figure 10:
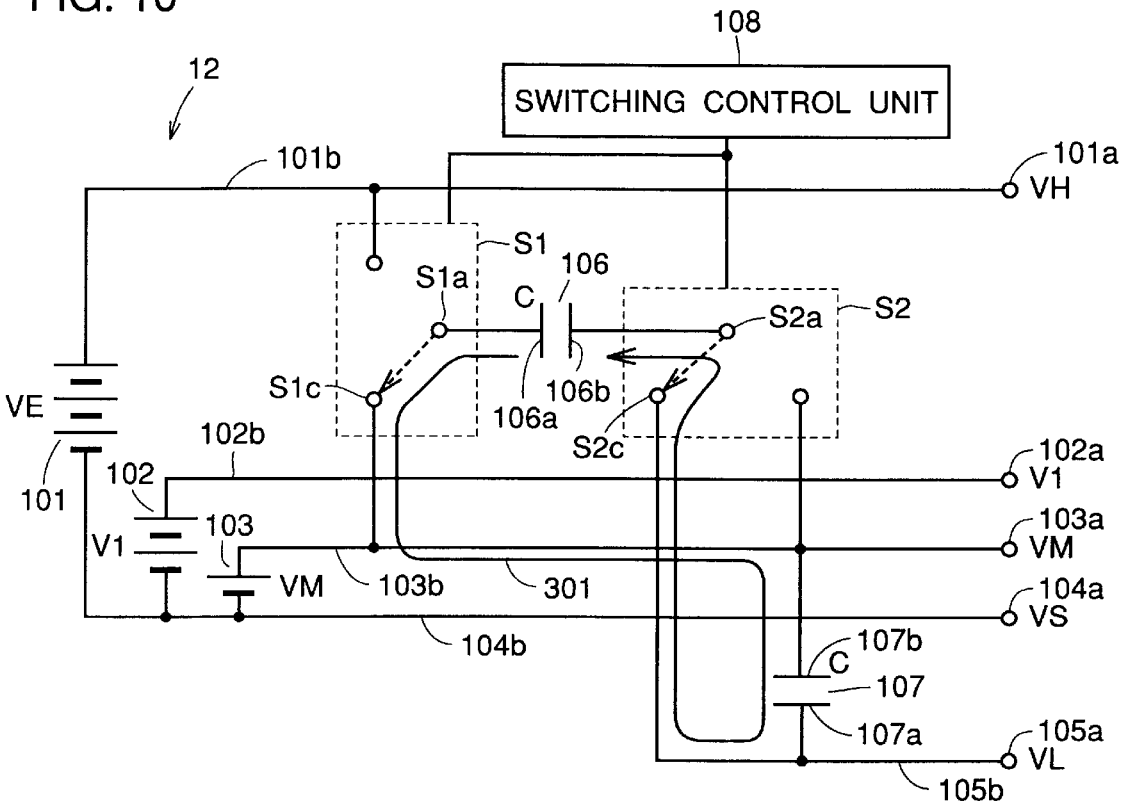

Referring to FIG. 9, when switching elements S1 and S2 are connected in the direction of the solid lines (S1*a*–S1*b*, S2*a*–S2*b*) by switching control unit 108, the current flows in the direction indicated by arrow 201, whereby charge corresponding to (VE−VM) is provided to capacitor 106. Referring to FIG. 10, when switching elements S1 and S2 are connected in the direction of the broken lines (S1*a*–S1*c*, S2*a*–S2*c*) by switching control unit 108, the current flows in the direction indicated by arrow 301, whereby the charge corresponding to (VE−VM) accumulated in capacitor 106 is discharged to charge capacitor 107.

Switching control unit 108 effects this switching control at the speed of approximately 10 kHz. Therefore, capacitor 106 repeats the charging from power supply 101 and the discharging towards capacitor 107 at the speed of approximately 10 kHz. Similarly, capacitor 107 repeats the charging from capacitor 106 and the discharging via the output terminal at the speed of approximately 10 kHz. In other words, capacitors 106 and 107 are charged and discharged in a complementary manner.

Since capacitor 107 is connected to potential line 103*b* supplying voltage VM, voltage value VL of output terminal 105*a* is $$VL=VM-(VE-VM)=-(VE-2\times VM)$$

Let VE=VH, then $$VH-VM=VM-VL$$

Therefore, voltage value VL of output terminal 105*a* meets the aforementioned equation (1).

According to the first embodiment of the present invention, a voltage value VL having a predetermined constant potential difference of VH−VM=VM−VL can be generated from the predetermined voltage values of VE(=VH), V1, VM and VS at a high conversion efficiency by a simple structure employing a switching element and a capacitor. Power consumption can be reduced in comparison to the case where the voltage is generated using a DC/DC converter. Also, the space can be reduced since the size of the substrate can be made smaller. A voltage generation circuit for a liquid crystal display that can realize reduction in cost can be provided.

Figure 2:
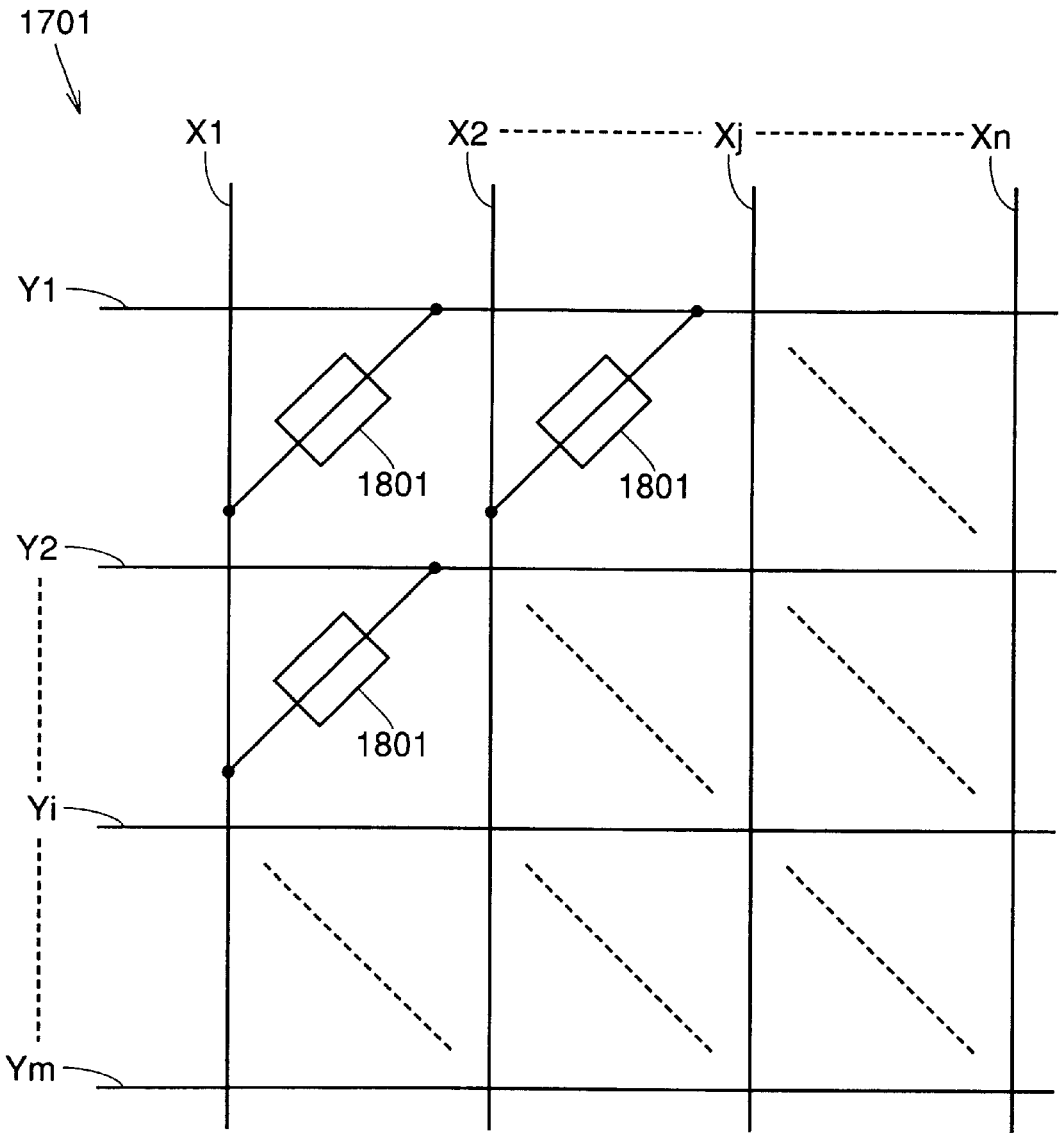
FIG. 2 PRIOR ART
FIG. 2 is a circuit diagram showing a structure of a pixel in a liquid crystal display.
Figure 3:
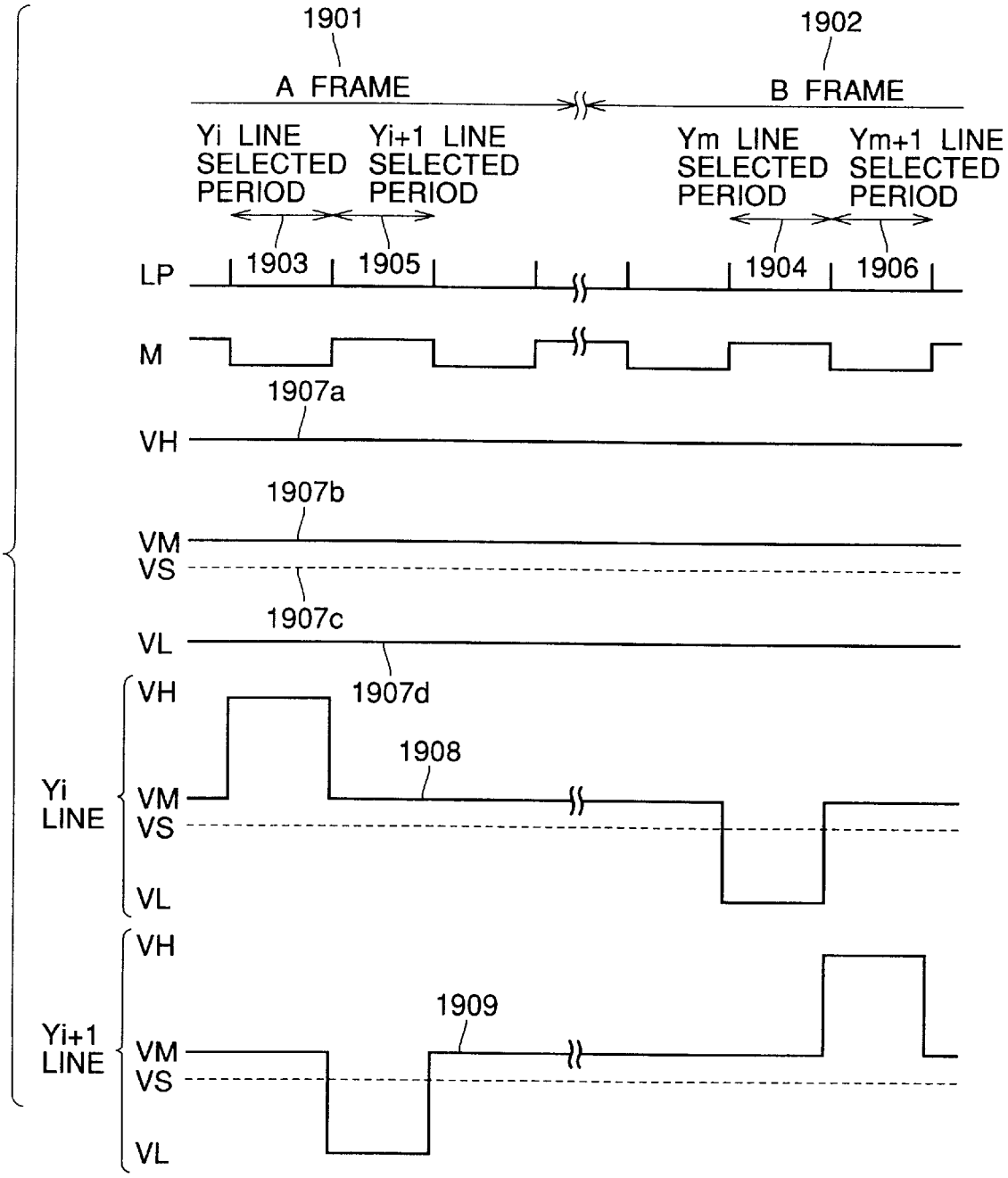
FIG. 3 PRIOR ART
FIGS. 3 and 4 are diagrams showing signal waveforms for describing a driving method of a liquid crystal display.
Figure 4:
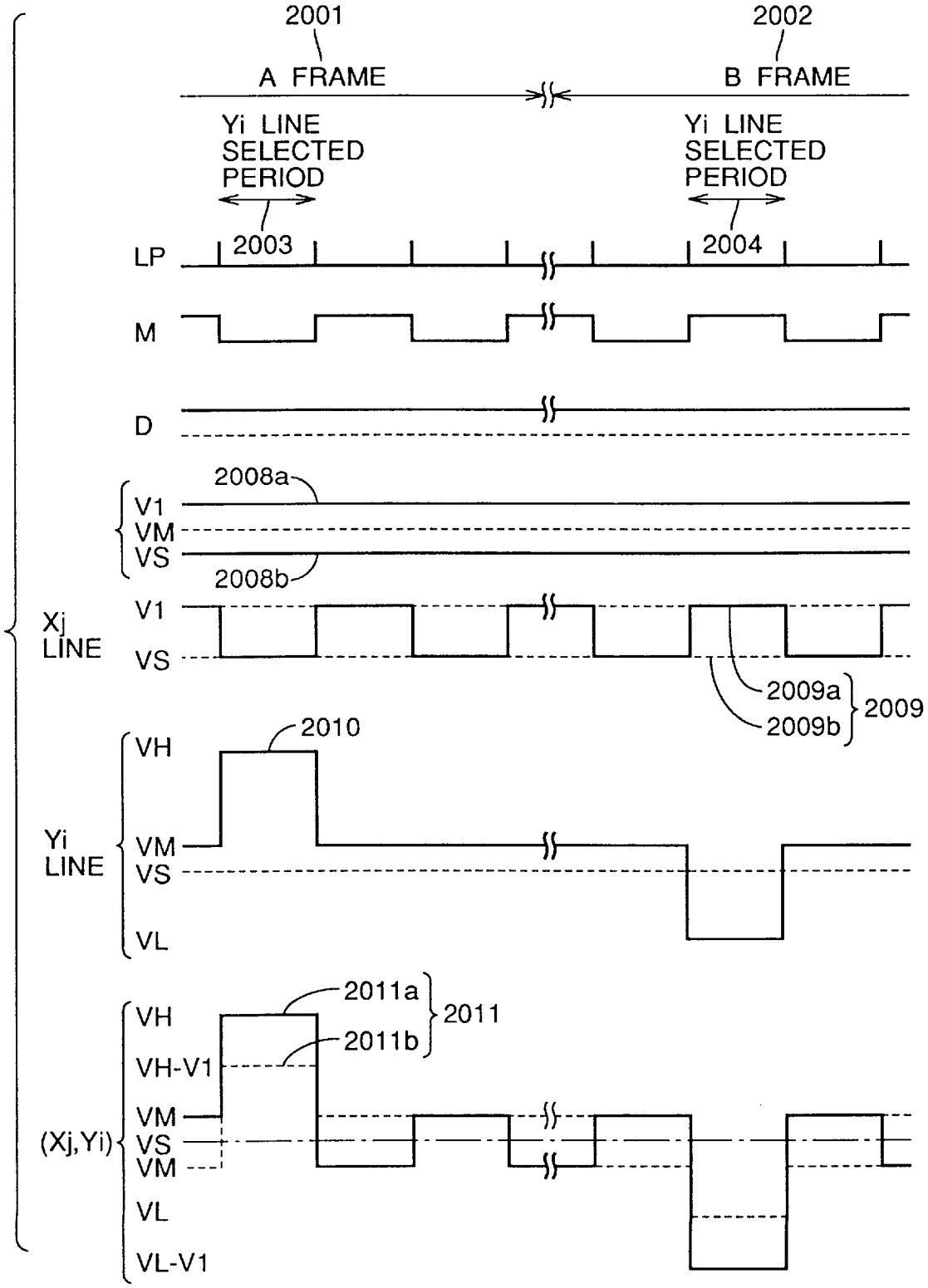
FIG. 4 PRIOR ART
Figure 5:
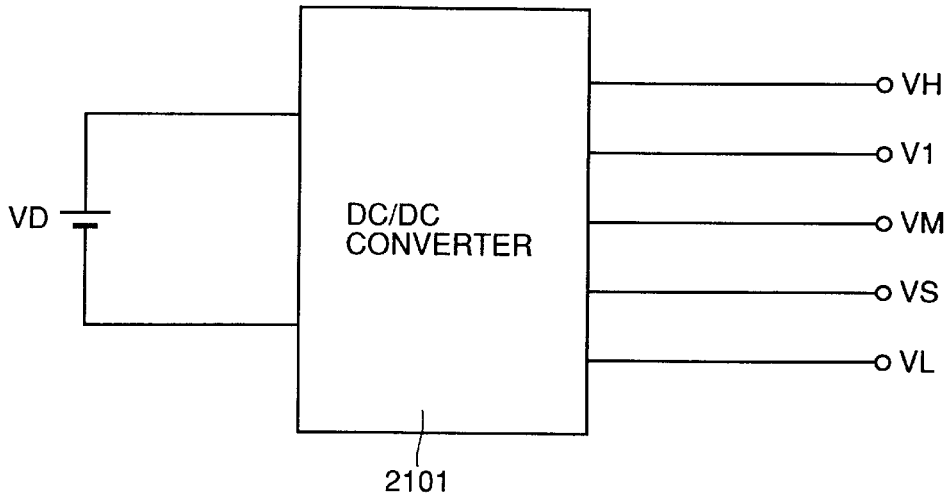
FIG. 5 PRIOR ART
FIG. 5 is a diagram for describing a conventional voltage generation circuit.
Figure 6:
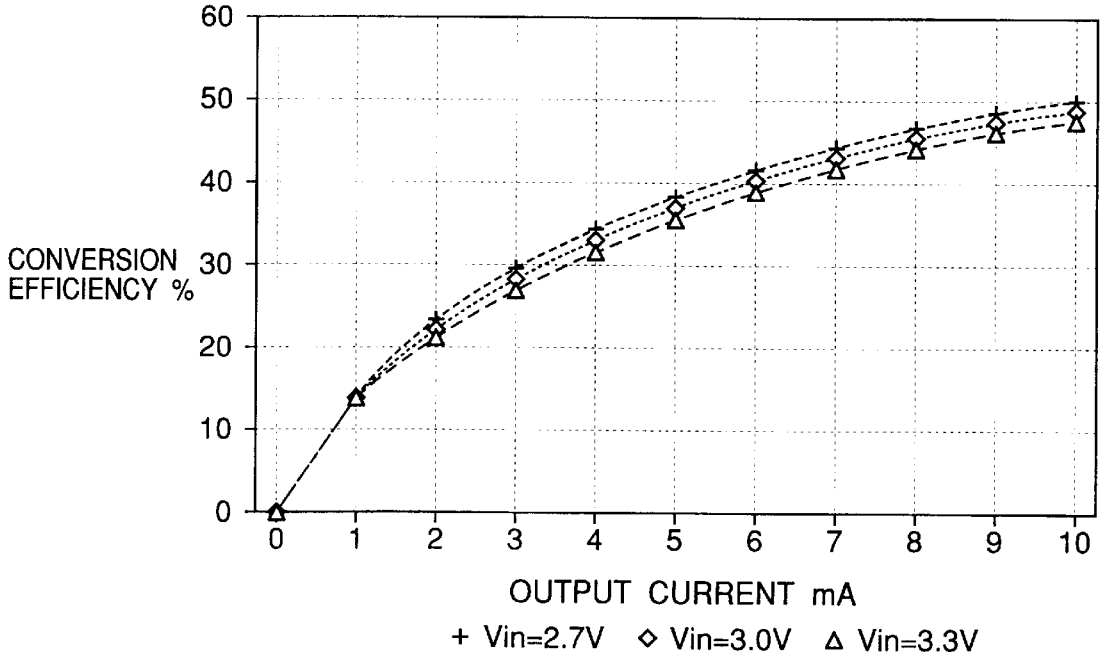
FIG. 6 PRIOR ART
FIG. 6 shows an example of the conversion efficiency in the low current region of a conventional voltage generation circuit.
Figure 11:
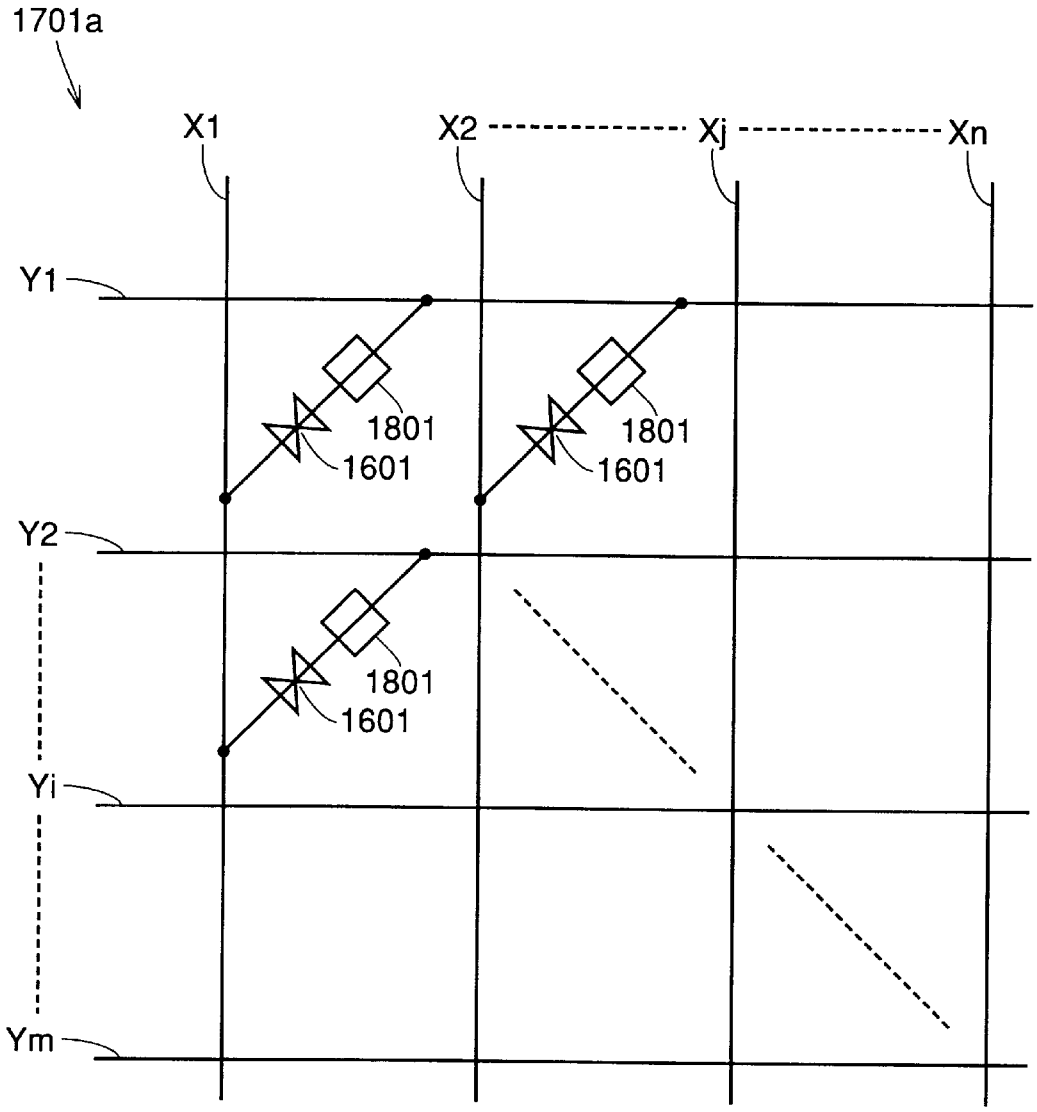
FIG. 11 is a circuit diagram showing a structure of a pixel in the liquid crystal display of the first embodiment.

Display panel 1701*a* according to the first embodiment will be described hereinafter with reference to FIG. 11. Components corresponding to those in display panel 1701 described with reference to FIG. 2 have the same reference characters allotted. Therefore, detailed description thereof will not be repeated here.

Liquid crystal display panel 1701*a* employs a 2-terminal nonlinear element 1601 as the switching element for each pixel. 2-terminal nonlinear pixel 1601 is connected in series with liquid crystal display element 1801 for each pixel at the respective crossing of scanning electrode Y1–Ym and data electrode X1–Xn. Since 2-terminal nonlinear element 1601 passes the current when a voltage exceeding a predetermined bias voltage is applied, the voltage applied to liquid crystal display element 1801 is held by 2-terminal nonlinear element 1601. Therefore, the current to be applied to liquid crystal display element 1801 is smaller than the conventional case where the voltage applied to liquid crystal display element 1801 is discharged with 2-terminal nonlinear element 1601 not employed. This means that the load with respect to the power source can be reduced. Thus, power loss can be reduced in comparison to the case where a DC/DC converter is employed.

According to the above-described first embodiment, the voltage generation circuit of a simple structure formed of a switching element and a capacitor can be applied to a liquid crystal display panel employing a 2-terminal nonlinear element. Therefore, a liquid crystal display that can have power consumption further reduced can be provided.

Figure 12:
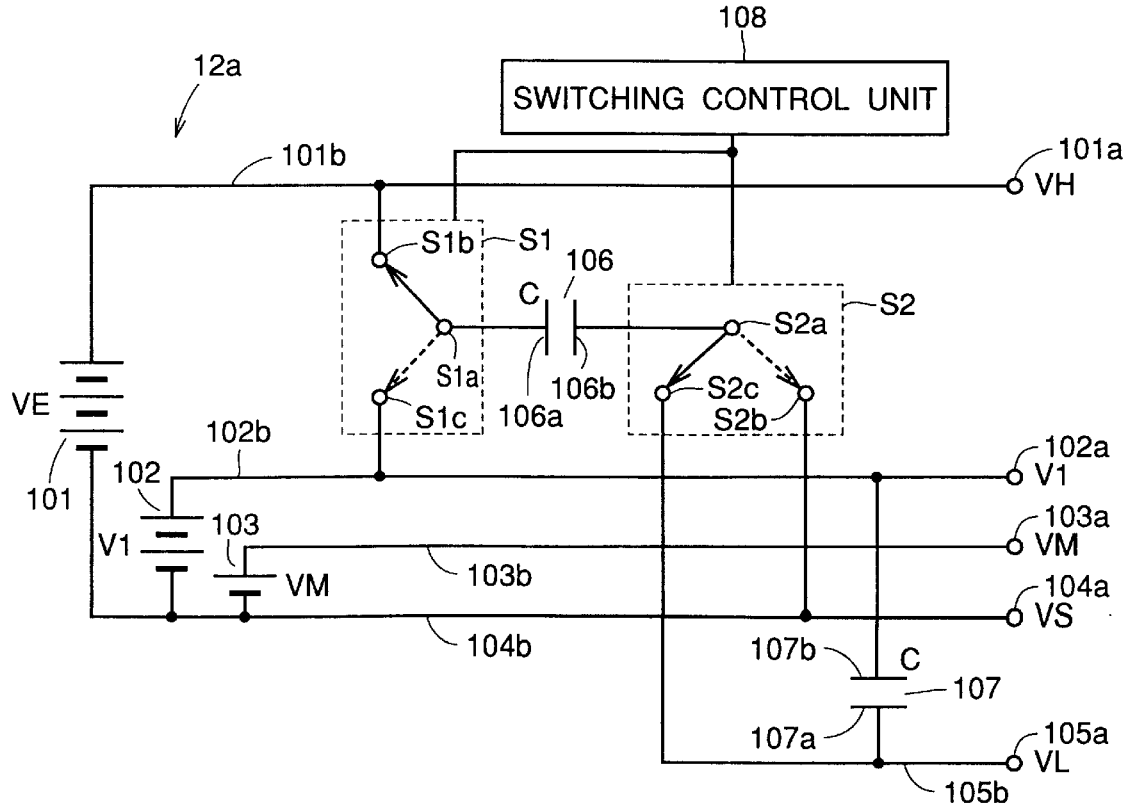
FIG. 12 is a diagram for describing a structure of a voltage generation circuit according to a second embodiment of the present invention.

A voltage generation circuit according to a second embodiment of the present invention will be described hereinafter with reference to FIG. 12. Components corresponding to those in the voltage generation circuit of the first embodiment have the same reference characters allotted. Therefore, detailed description thereof will not be repeated here.

The voltage generation circuit of the second embodiment differs from the voltage generation circuit of the first embodiment in that terminal S1*c* of switching element S1 is connected to second potential line 102*b*, and terminal S2*b* of switching element S2 is connected to reference potential line 104*b*.

Figure 13:
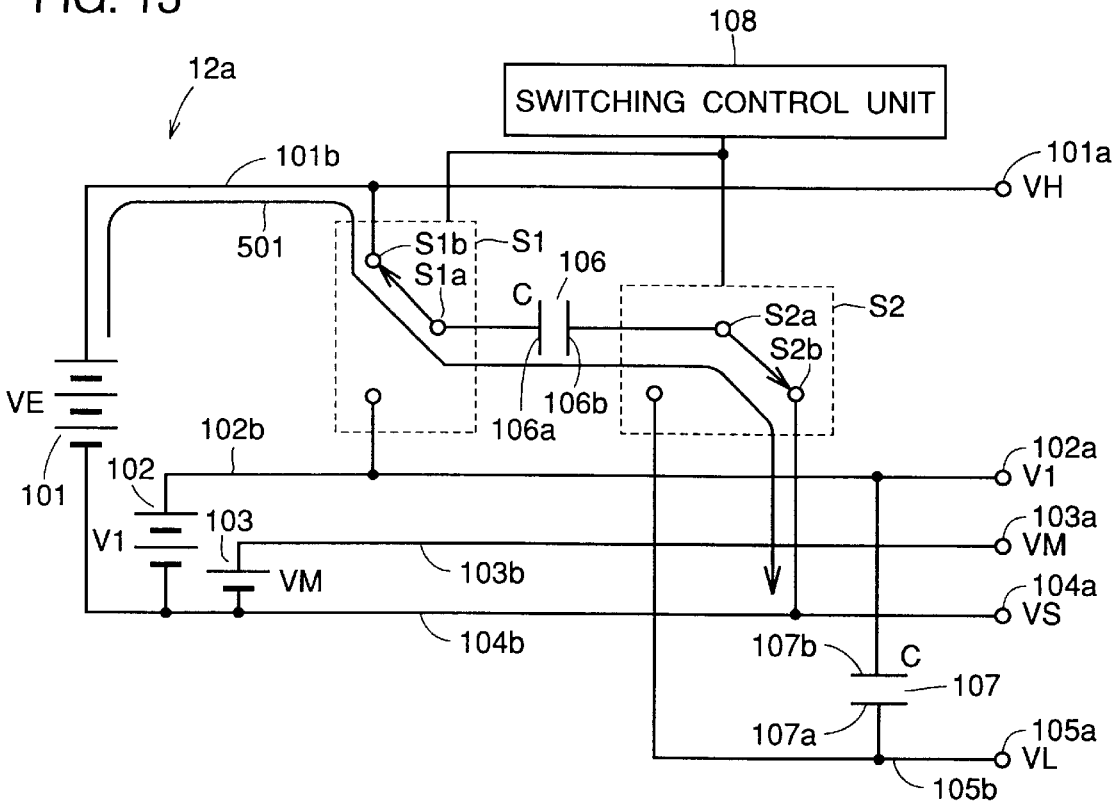
FIGS. 13 and 14 are diagrams for describing an operation of the voltage generation circuit of the second embodiment.
Figure 14:
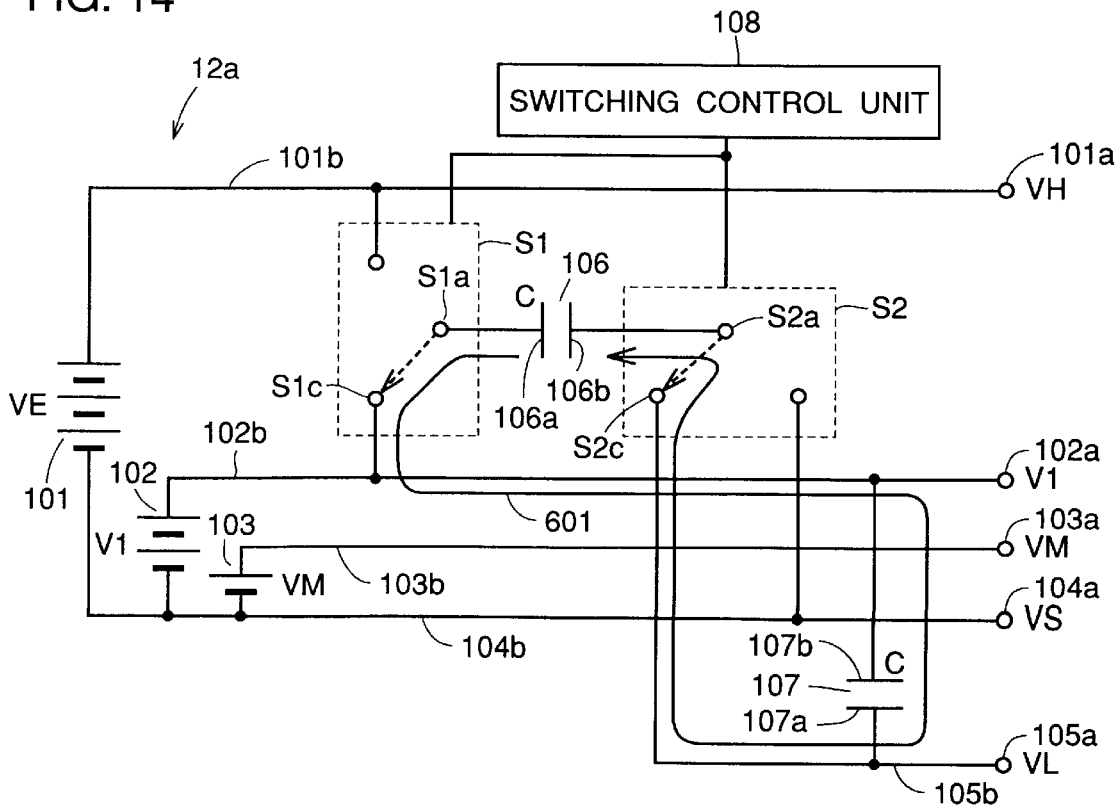

The current flow in the voltage generation circuit of the second embodiment is set forth in the following. Referring to FIG. 13, when switching elements S1 and S2 are connected in the direction of the solid lines (S1*a*–S1*b*, S2*a*–S2*b*) by switching control unit 108, current flows in the direction indicated by arrow 501, whereby charge corresponding to (VE−VS) is provided to capacitor 106. Referring to FIG. 14, when switching elements S1 and S2 are connected in the direction of the broken lines (S1*a*–S1*c*, S2*a*–S2*c*) by switching control unit 108, the current flows in the direction indicated by arrow 601, whereby the charge corresponding to (VE−VS) accumulated in capacitor 106 is discharged to be provided to capacitor 107.

Similar to the first embodiment, switching control unit 108 carries out this switching control at the speed of approximately 10 kHz. Therefore, capacitor 106 repeats the charging from power supply 101 and the discharging towards capacitor 107 at the speed of approximately 10 kHz. Similarly, capacitor 107 repeats the charging from capacitor 106 and the outward discharging via output terminal 105*a* at the speed of approximately 10 kHz. In other words, capacitors 106 and 107 are charged and discharged in a complementary manner. A likewise operation is carried out hereinafter.

In capacitor 107, second potential line 102*b* that provides voltage value V1 of power supply 102 is the reference. Potential VL of output terminal 105*a* is $$VL=V1-(VE-VS)=(V1+VS)-VE$$

Since VM=(VS+VS)/2, $$VL=2\times VM-VE$$

Since VE=VH, $$VL=2\times VM-VH, \text{ then}$$

$$VH-VM=VM-VL$$

Therefore, potential VL of output terminal 105*a* meets equation (1).

Figure 15:
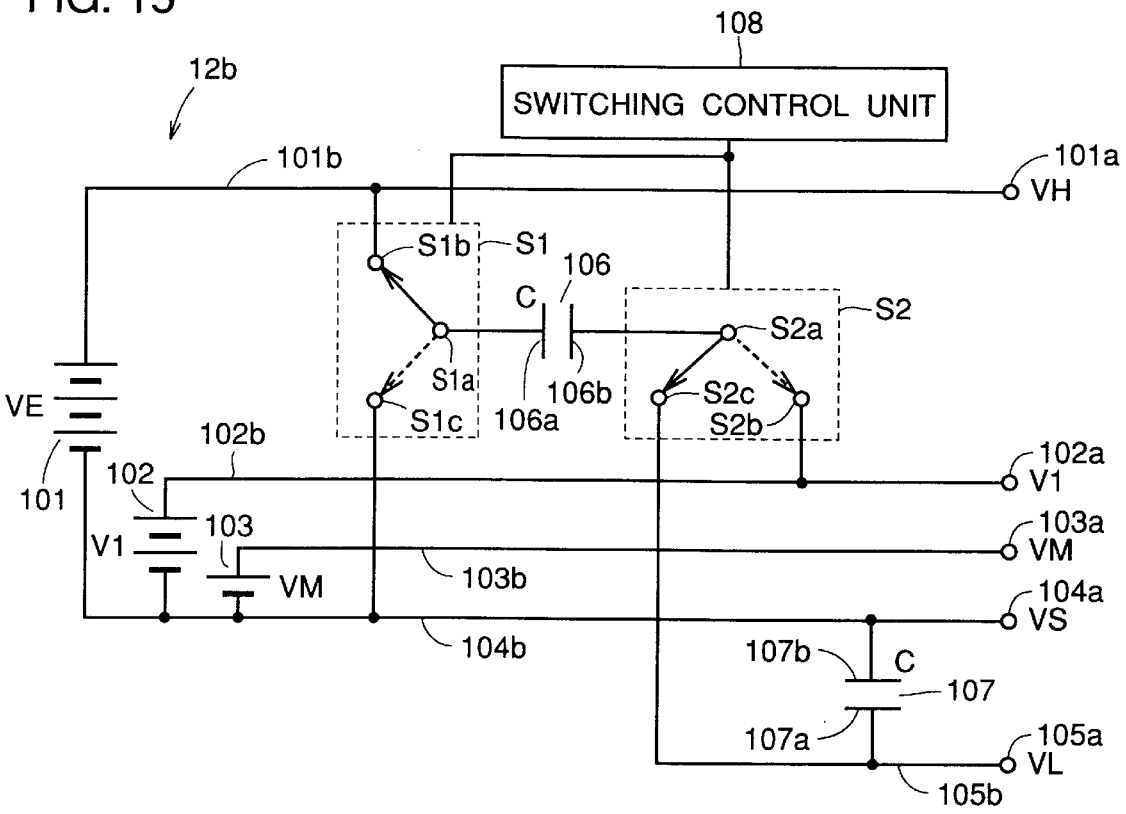
FIG. 15 is a diagram for describing a structure of a voltage generation circuit according to a third embodiment.

A voltage generation circuit according to a third embodiment of the present invention will be described hereinafter with reference to FIG. 15. The voltage generation circuit of the third embodiment differs from the voltage generation circuit of the first embodiment in that terminal S1*c* of switching element S1 is connected to reference potential line 104*b*, and terminal S2*b* of switching element S2 is connected to second potential line 102*b*.

Figure 16:
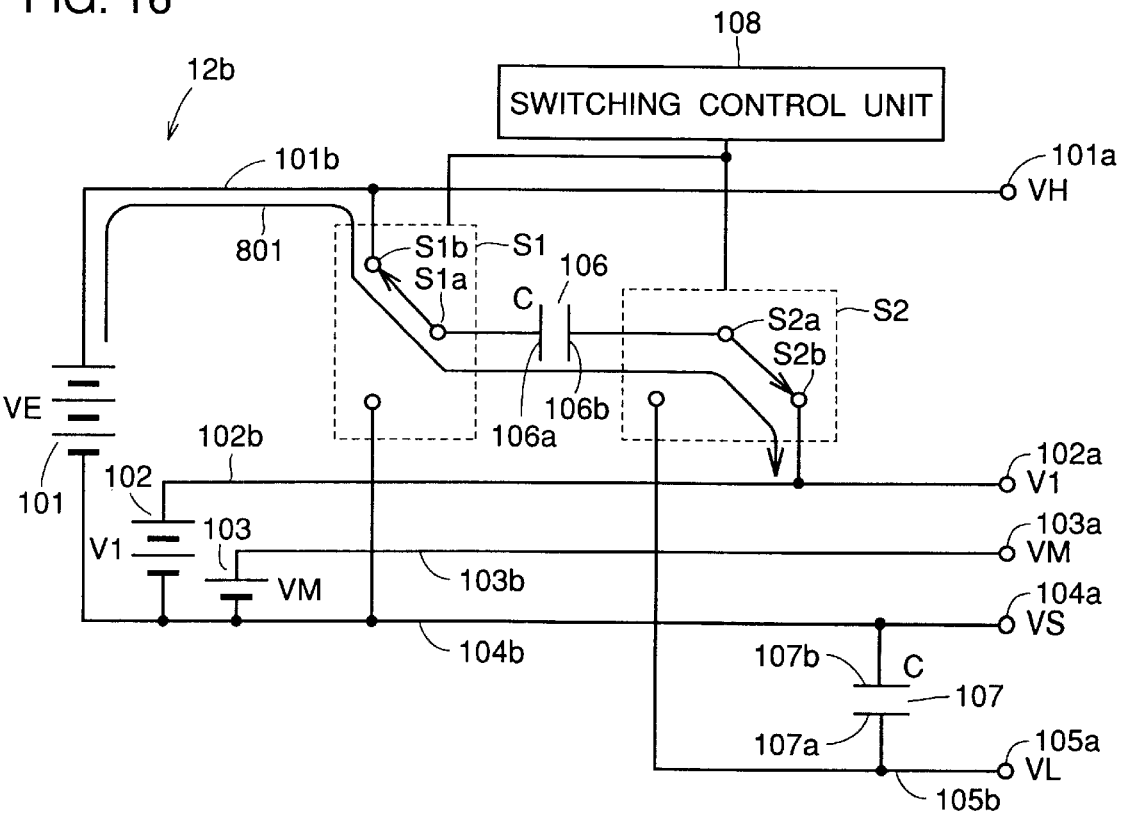
FIGS. 16 and 17 are diagrams for describing an operation of the voltage generation circuit of the third embodiment.
Figure 17:
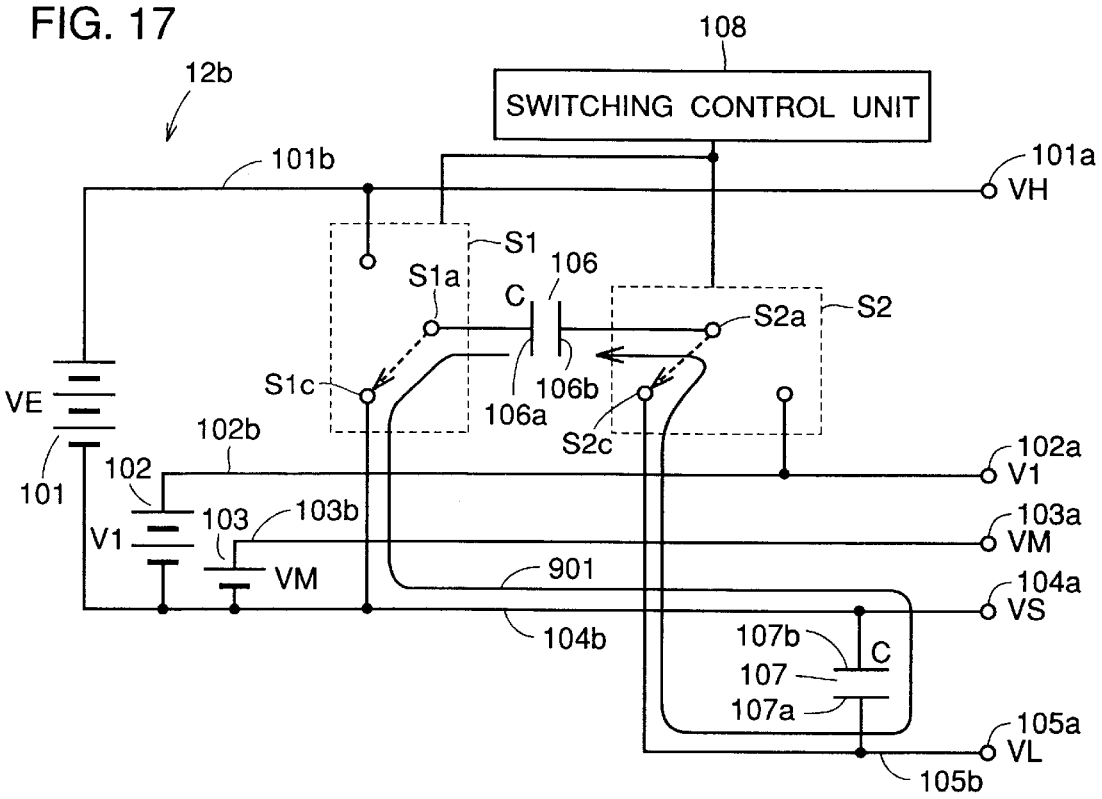

The current flow in the voltage generation circuit of the third embodiment is set forth in the following. Referring to FIG. 16, when switching elements S1 and S2 are connected in the direction of the solid lines (S1*a*–S1*b*, S2*a*–S2*b*) by switching control unit 108, the current flows in the direction indicated by arrow 801, whereby charge corresponding to (VE−V1) is provided to capacitor 106. Referring to FIG. 17, when switching elements S1 and S2 are connected in the direction of the broken lines (S1*a*–S1*c*, S1*a*–S2*c*) by switching control unit 108, the current flows in the direction indicated by arrow 901, whereby the charge corresponding to (VE−V1) in capacitor 106 is discharged to charge capacitor 107.

In capacitor 107, reference potential VS is the reference. Voltage VL of output terminal 105*a* is $$VL=VS-(VE-V1)=(V1+VS)-VE$$

Since VM=(V1+VS)/2, $$VL=2\times VM-VE$$

Since VE=VH, $$VL=2\times VM-VH, \text{ then}$$

$$VH-VM=VM-VL$$

Therefore, voltage VL of output terminal 105*a* meets equation (1).

Figure 18:
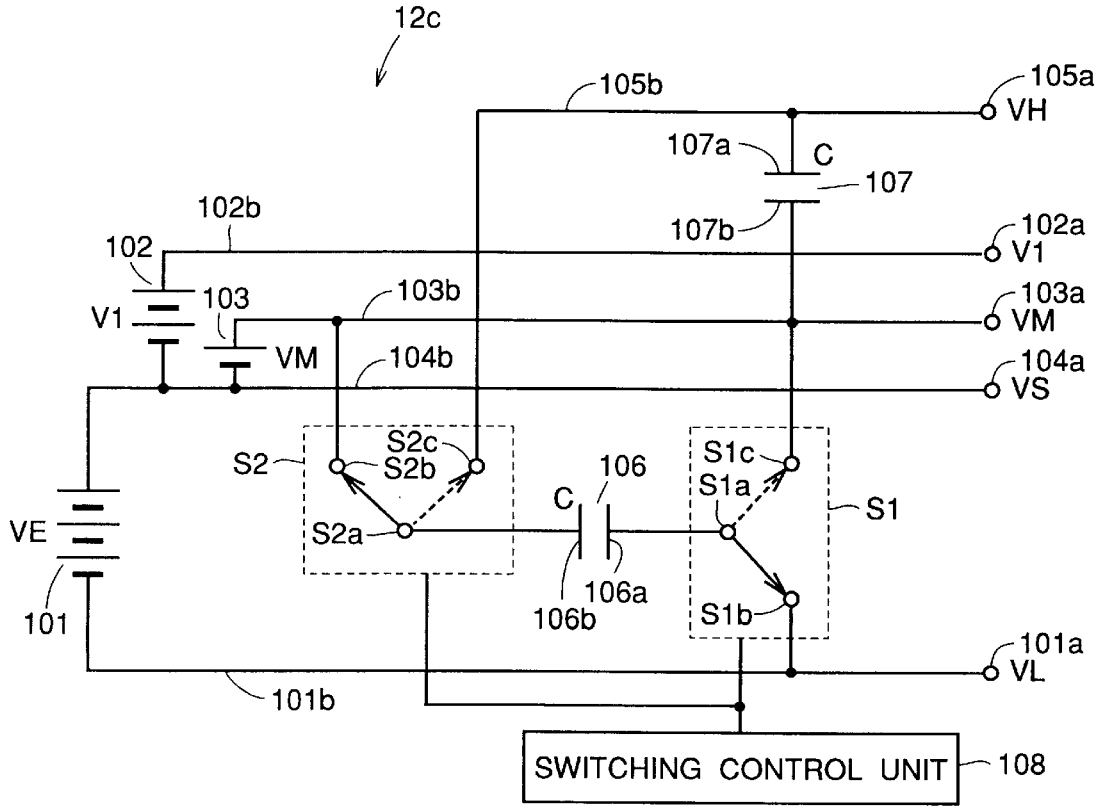
FIG. 18 is a diagram for describing a structure of a voltage generation circuit according to a fourth embodiment.

A voltage generation circuit according to a fourth embodiment of the present invention will be described hereinafter with reference to FIG. 18. The voltage generation circuit of the fourth embodiment is arranged so that power supply 101 having a voltage VE of voltage generation circuit 12 of the first embodiment shown in FIGS. 8–10 is negative in polarity with respect to reference potential VS.

Voltage generation circuit 12*c* includes a reference potential line 104*b* supplying a reference voltage value VS, a power supply 101 having one end connected to reference potential line 104*b* for supplying a voltage of voltage value VE having a negative polarity with respect to reference voltage value VS, a power supply 102 having one end connected to reference potential line 104*b* for supplying a voltage of voltage value V1, a power supply 103 having one end connected to reference potential line 104*b* for supplying a voltage of voltage value VM defined by VM=(VS+VS)/2, a potential line 101*b* connected to the other end of power supply 101 for supplying voltage value VE, a potential line 102*b* connected to the other end of power supply 102 for supplying a voltage of a voltage value V1 that is symmetric to reference voltage value VS about voltage value VM, a potential line 103*b* connected to power supply 103 for supplying voltage of voltage value VM, and a potential line 105*b* from which a voltage of voltage value VH is provided.

Voltage generation circuit 12*c* further includes a capacitor 106 having terminals 106*a* and 106*b*, a capacitor 107 having a terminal 107*a* connected to potential line 105*b* and a terminal 107*b*, and having a capacitance C equal to the capacitance C of capacitor 106, a switching element S1 for selectively connecting terminal 106*a* of capacitor 106 to potential line 101*b* and potential line 103*b*, a switching element S2 for selectively connecting terminal 106*b* of capacitor 106 to power supply line 103*b* and terminal 107*b* of capacitor 107, a switching control unit 108 connected to switching elements S1 and S2 for controlling the connection switching of switching elements S1 and S2 so that capacitors 106 and 107 are charged and discharged in a complementary manner, and output terminals 101*a*, 102*a*, 103*a*, 104*a* and 105*a* connected to potential lines 101*b*, 102*b*, 103*b*, 104*b* and 105*b*, respectively.

Switching element S1 includes a terminal S1*a* connected to terminal 106*a* of capacitor 106, a terminal S1*b* connected to potential line 101*b*, and a terminal S1*c* connected to potential line 103*b*.

Switching element S2 includes a terminal S2*a* connected to terminal 106*b* of capacitor 106, a terminal S2*b* connected to potential line 103*b*, and a terminal S2*c* connected to terminal 107*a* of capacitor 107.

The current flow in voltage generation circuit 12*c* is set forth in the following.

Figure 19:
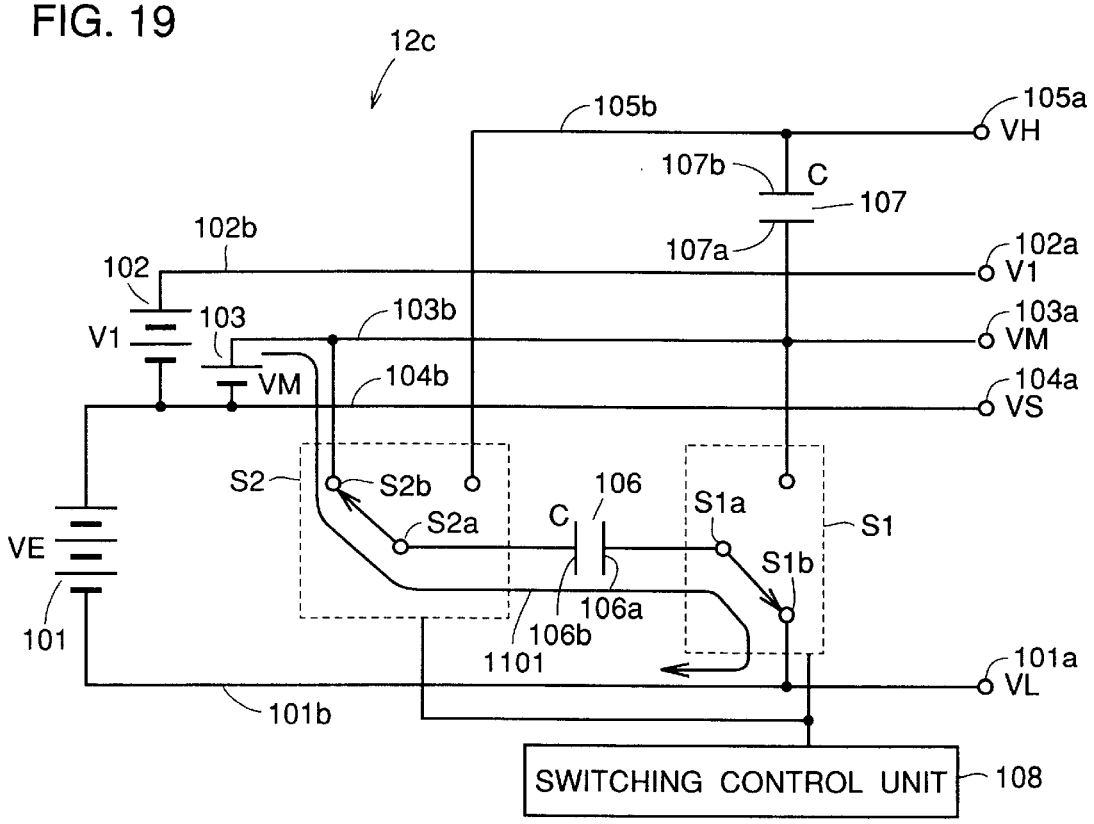
FIGS. 19 and 20 are diagrams for describing an operation of the voltage generation circuit of the fourth embodiment.
Figure 20:
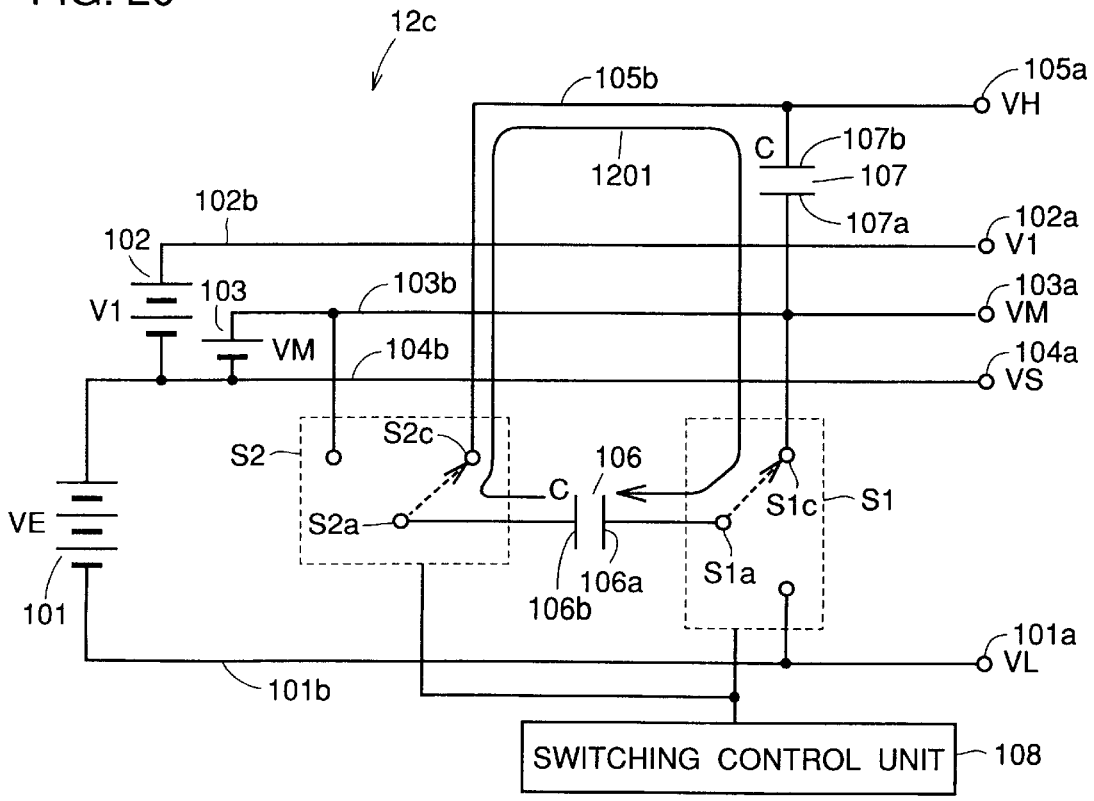

Referring to FIG. 19, when switching elements S1 and S2 are connected in the direction of the solid lines (S1*a*–S1*b*, S2*a*–S2*b*) by switching control unit 108, the current flows in the direction indicated by arrow 1101, whereby charge corresponding to $$(VM-(-VE))=(VM+VE)$$

is provided to capacitor 106. Referring to FIG. 20, when switching elements S1 and S2 are connected in the direction of the broken lines (S1*a*–S1*c*, S2*a*–S2*c*) by switching control unit 108, current flows in the direction indicated by arrow 1201, whereby charge corresponding to (VM+VE) in capacitor 106 is discharged to be provided to capacitor 107.

In capacitor 107, potential line 103*b* supplying voltage value VM is the reference. Voltage value VH of output terminal 101*a* becomes $$VH=VM+(VM+VE)=2\times VM+VE$$

Let VE=−VL, then $$VH=2\times VM-VL$$

$$VH-VM=VM-VL$$

Therefore, voltage value VH of output terminal 101*a* meets equation (1).

A voltage value VH can be generated from voltage value VL by arranging the voltage generation circuit of the second and third embodiments so that power supply 101 of voltage value VE has a negative polarity with respect to reference potential VS.

Figure 21:
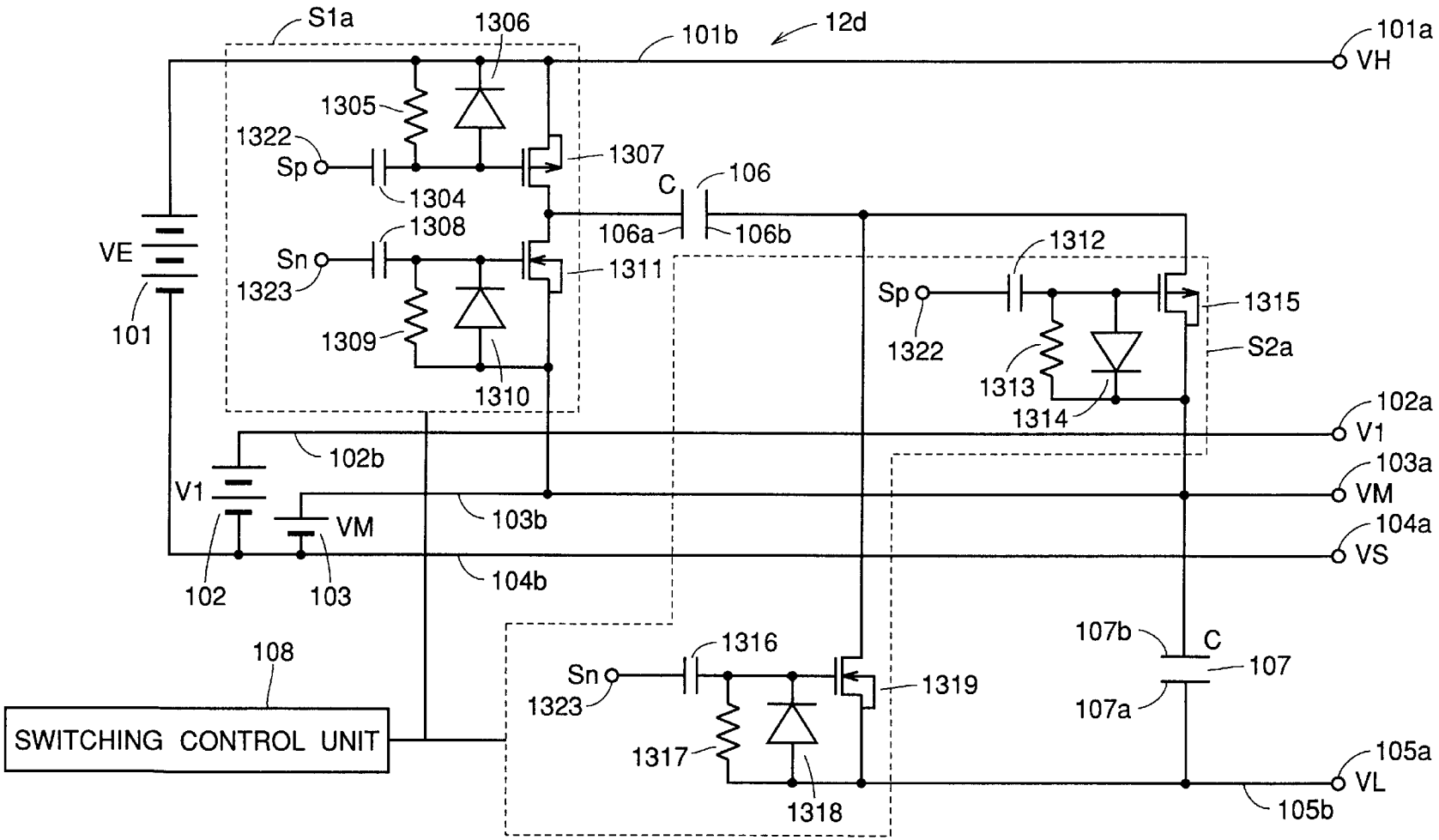
FIG. 21 is a diagram for describing a structure of a voltage generation circuit according to a fifth embodiment.

A voltage generation circuit according to a fifth embodiment of the present invention will be described hereinafter with reference to FIG. 21. The voltage generation circuit of the present fifth embodiment is an example of employing a MOS (Metal Oxide Semiconductor) FET (Field Effect Transistor) as the switching element in voltage generation circuit 12 of the first embodiment.

A switching element S1*a* corresponding to switching element S1 of FIG. 8 includes a P channel MOSFET 1307, an N channel MOSFET 1311, a diode 1306, a diode 1310, a resistor 1305, a resistor 1309, a capacitor 1304, a capacitor 1308, an input terminal 1322 for a control signal Sp, and an input terminal 1323 for a control signal Sn.

Similarly, a switching element S2*a* corresponding to switching element S2 of FIG. 8 includes a P channel MOSFET 1315, an N channel MOSFET 1319, a diode 1314, a diode 1318, a resistor 1313, a resistor 1317, a capacitor 1312, a capacitor 1316, an input terminal 1322 for control signal Sp and an input terminal 1323 for control signal Sn.

Figure 22:
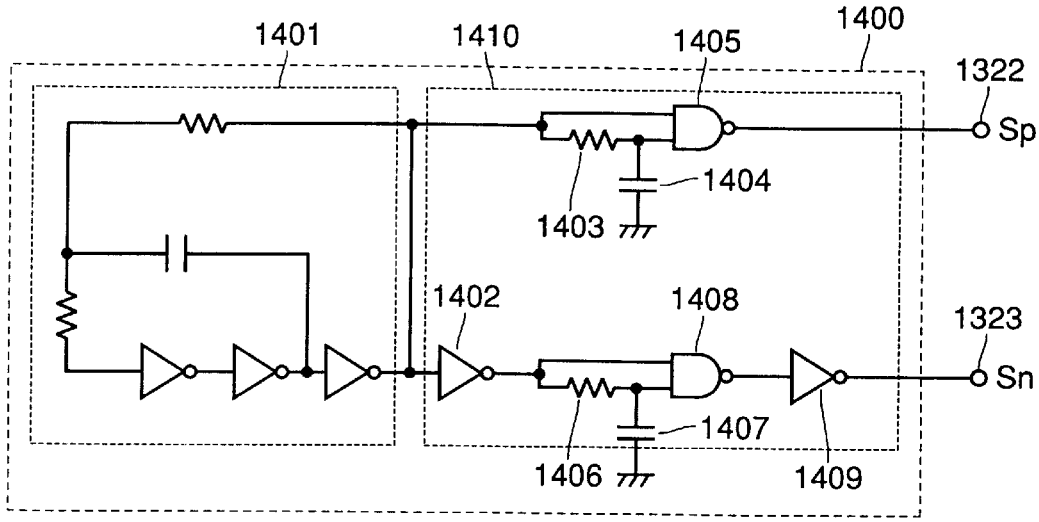
FIG. 22 is a diagram for describing a control signal generation circuit in the voltage generation circuit of the fifth embodiment.
Figure 23:
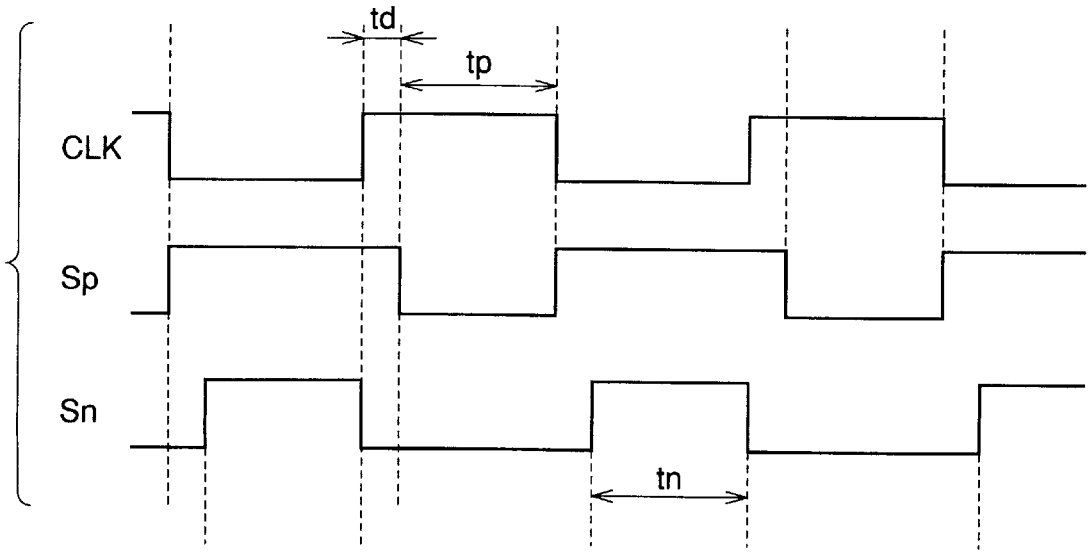
FIG. 23 is a diagram for describing a control signal in the voltage generation circuit of the fifth embodiment.

The circuit for generating control signals Sp and Sn will be described with reference to FIGS. 22 and 23. A control signal generation circuit 1400 includes a CR (capacitor•resistor) oscillator circuit 1401, and an integrating circuit 1410. CR oscillator circuit 1401 generates a signal CLK indicated in FIG. 23. Integrating circuit 1410 includes NOT circuits 1402 and 1409, NAND (Not AND) circuits 1405 and 1408, resistors 1403 and 1406, and capacitors 1404 and 1407. Integrating circuit 1410 generates a delay time td to generate control signals Sp and Sn.

Control signal Sp is applied to a P channel MOSFET to turn on the P channel MOSFET for a period tp. Control signal Sn is applied to an N channel MOSFET to turn on the same in period tn. Delay time td is provided so that a P channel MOSFET and an N channel MOSFET are not turned on at the same time.

Figure 24:
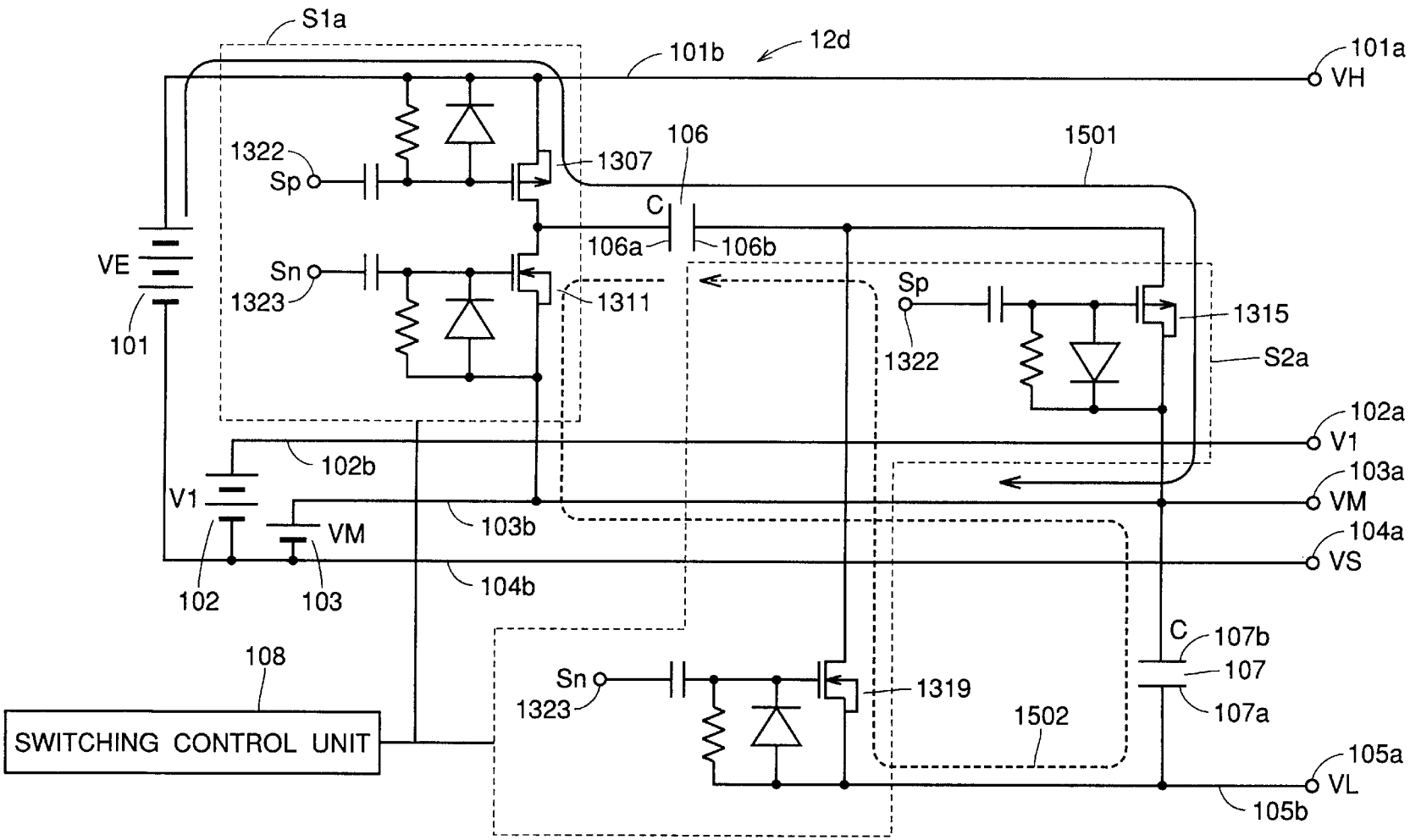
FIG. 24 is a diagram for describing an operation of the voltage generation circuit of the fifth embodiment.

The current flow will be described with reference to FIG. 24. By switching control unit 108, P channel MOSFET 1307 and 1315 are turned on during period tp so that current flows in the direction indicated by the solid line arrow 1501. Therefore, charge corresponding to (VE−VM) is charged to capacitor 106. At the next period tn, N channel MOSFETs 1311 and 1319 are turned on, whereby a current flows in the direction indicated by the broken line arrow 1502. Therefore, the charge corresponding to (VE−VM) accumulated in charge 106 is discharged to be supplied to capacitor 107.

In capacitor 107, potential line 103*b* supplying voltage value VM is the reference. Voltage value VL of output terminal 105*a* becomes $$VL=VM-(VE-VM)=-(VE-2\times VM)$$

Let VE=VH, then $$VH-VM=VM-VL$$

Therefore, voltage value VL of output terminal 105*a* satisfies equation (1).

A similar voltage generation circuit can be implemented using a MOS type FET as a switching transistor for the voltage generation circuits of the previously described second, third and fourth embodiments.

According to a voltage generation circuit of the present invention, a voltage having a predetermined constant potential difference can be generated from a predetermined voltage at high conversion efficiency with a simple structure formed of a switching element, a MOSFET, a capacitor, and the like. In comparison with the case where a DC/DC converter is used, power consumption can be reduced as well as reducing the space since the size of the substrate can be reduced. Furthermore, the cost can be reduced. A liquid crystal display and a voltage generation circuit for a liquid crystal display of the above advantages can be provided.

Power consumption can be reduced to approximately ⅓ In than that using a DC/DC converter. The space can be reduced to approximately ⅕ in volume ratio. Also, the space can be used more effectively than the volume ratio since components can be laid out arbitrarily. Furthermore, the cost can be reduced since the expensive DC/DC converter is not used and substituted with an inexpensive component.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A voltage generation circuit for generating a voltage value VB defined by the equation of (VA−VM)=(VM−VB) from a reference voltage value VS, a predetermined voltage value VA, a predetermined voltage value V1, and a voltage value VM defined by VM=(V1+VS)/2, said voltage generation circuit comprising:

a first potential line for said voltage value VA, a potential line group of second potential lines for said voltage value V1, a potential line for said voltage value VM, and a potential line for said reference voltage value VS, a third potential line for said voltage value VB, a first capacitive element including first and second terminals, a second capacitive element including a first terminal connected to said third potential line and a second terminal connected to a predetermined one potential line out of said potential line group, and having a capacitance equal to the capacitance of said first capacitive element, a first switching element for selectively connecting said first terminal of said first capacitive element to said first potential line and said predetermined one potential line out of said potential line group, and a second switching element for selectively connecting said second terminal of said first capacitive element to a potential line that supplies a potential symmetric to said predetermined one potential line out of said potential line group with respect to said voltage value VM, and said first terminal of said second capacitive element, wherein connection switching of said first and second switching elements is controlled so that said first and second capacitive elements are charged and discharged in a complementary manner.

2. The voltage generation circuit according to claim 1, wherein said predetermined one potential line is said potential line applying a voltage value VM.

3. The voltage generation circuit according to claim 1, wherein said predetermined one potential line is one of said second potential lines applying voltage value V1.

4. The voltage generation circuit according to claim 1, wherein said predetermined one potential line is said potential line applying voltage value VS.

5. The voltage generation circuit according to claim 1, wherein said voltage value VA is a voltage value VH having a positive polarity with respect to said reference voltage value VS, and said voltage value VB is a voltage value VL having a negative polarity with respect to said reference voltage value VS.

6. The voltage generation circuit according to claim 1, wherein said voltage value VA is a voltage value VL having a negative polarity with respect to said reference voltage value VS, and said voltage value VB is a voltage value VH having a positive polarity with respect to said reference voltage value VS.

7. The voltage generation circuit according to claim 1, wherein at least one of said first switching element and said second switching element is a MOS type FET.

8. The voltage generation circuit according to claim 1, further comprising a control circuit for controlling connection switching of said first and second switching elements so that said first and second capacitive elements are charged and discharged in a complementary manner.

9. A voltage generation circuit for generating a voltage value VB defined by an equation of (VA−VM)=(VM−VB) from a predetermined voltage value VA and a predetermined voltage value VM, said voltage generation circuit comprising:

a first potential line for said voltage value VA, a second potential line for said voltage value VM, a third potential line for said voltage value VB, a first capacitive element including first and second terminals, a second capacitive element including a first terminal connected to said third potential line, and a second terminal connected to said second potential line, and having a capacitance equal to the capacitance of said first capacitive element, a first switching element for selectively connecting said first terminal of said first capacitive element to said first potential line and said second potential line, and a second switching element for selectively connecting said second terminal of said first capacitive element to said second potential line and said first terminal of said second capacitive element, wherein connection switching of said first and second switching elements is controlled so that said first and second capacitive elements are charged and discharged in a complementary manner.

10. A voltage generation circuit for generating a voltage value VB defined by an equation of (VA−VM)=(VM−VB) with respect to a voltage value VM defined by VM=(V1+VS)/2 from a reference voltage value VS, a predetermined voltage value VA, and a predetermined voltage value V1, said voltage generation circuit comprising:

a first potential line for said voltage value VA, a second potential line for said voltage value V1, a third potential line for said voltage value VB, a fourth potential line for said reference voltage value VS, a first capacitive element including first and second terminals, a second capacitive element including a first terminal connected to said third potential line and a second terminal connected to said second potential line, and having a capacitance equal to the capacitance of said first capacitive element, a first switching element for selectively connecting said first terminal of said first capacitive element to said first potential line and said second potential line, and a second switching element for selectively connecting said second terminal of said first capacitive element to said fourth potential line and said first terminal of said second capacitive element, wherein connection switching of said first and second switching elements is controlled so that said first and second capacitive elements are charged and discharged in a complementary manner.

11. A voltage generation circuit for generating, a reference voltage value VS, a predetermined voltage value VA, a predetermined voltage value V1, and a voltage value VB defined by an equation of (VA−VM)=(VM−VB) with respect to a voltage value VM defined by VM=(V1+VS)/2, said voltage generation circuit comprising:

a first potential line for said voltage value VA, a second potential line for said voltage value V1, a third potential line for said voltage value VB, a fourth potential line for said reference voltage value VS, a first capacitive element including first and second terminals, a second capacitive element including a first terminal connected to said third potential line, and a second terminal connected to said second potential line, and having a capacitance equal to the capacitance of said first capacitive element, a first switching element for selectively connecting said first terminal of said first capacitive element to said first potential line and said fourth potential line, and a second switching element for selectively connecting said second terminal of said first capacitive element to said second potential line and said first terminal of said second capacitive element, wherein connection switching of said first and second switching elements is controlled so that said first and second capacitive elements are charged and discharged in a complementary manner.

* * * * *